US005782365A

United States Patent [19]

Zreloff et al.

[11] Patent Number: 5,782,365

[45] Date of Patent: Jul. 21, 1998

[54] BLADE GUIDE FOR A BLADE SCREEN

[75] Inventors: Peter J. Zreloff, Alpharetta; Alexander D. Cormack, Marietta; Bengt A. Nilsson, Atlanta, all of Ga.

[73] Assignee: BMH Wood Technology, Inc., Atlanta, Ga.

[21] Appl. No.: 538,707

[22] Filed: Oct. 3, 1995

[51] Int. Cl.[6] ..... B07B 1/49

[52] U.S. Cl. ..... 209/674; 209/394; 209/395

[58] Field of Search ..... 209/393, 394, 209/395, 404, 405, 408, 409, 659, 660, 674

[56] References Cited

U.S. PATENT DOCUMENTS

| | | | |
|---|---|---|---|
| 2,010,256 | 8/1935 | Cole | 209/395 |
| 3,123,558 | 3/1964 | Sullivan | 209/393 |
| 4,504,386 | 3/1985 | Dyren et al. | 209/674 X |
| 4,696,738 | 9/1987 | Risley | 209/674 |
| 4,960,510 | 10/1990 | Wolff | 209/395 X |
| 5,117,983 | 6/1992 | Marrs | 209/674 |
| 5,284,251 | 2/1994 | Marrs et al. | 209/396 |
| 5,305,891 | 4/1994 | Bielagus | 209/396 |
| 5,367,158 | 11/1994 | Marrs et al. | 209/396 |
| 5,398,819 | 3/1995 | Cormack et al. | 209/674 |

FOREIGN PATENT DOCUMENTS

| | | | |
|---|---|---|---|
| 653630 | 5/1963 | Italy | 209/674 |
| 242912 | 1/1964 | Netherlands | 209/674 |

OTHER PUBLICATIONS

Strakes, G., et al., *New Chip Thickness Screening System Boosts Efficiency, Extends Wear Life: First coommercial installation, at Mead Corp. 's Chillicothe, Ohio, mill, results in overthick chip removal efficiency of 98%, Pulp & Paper,* (*Miller Freeman* 1992) (6 unmumbered pages).

Technical Data, S.H. Bushing, undated (1 page).

*Primary Examiner*—Joseph E. Valenza

*Assistant Examiner*—Evan Nguyen

*Attorney, Agent, or Firm*—Needle & Rosenberg, PC

[57] ABSTRACT

A blade guide for a dual-frame wood chip sorter comprising a plurality of fingers having a slot therethrough to receive therein a blade, first and second mounting plates on each frame mounting thereon the bottom of a respective number of the fingers. At least one blade on the first frame is disposed intermediate adjacent fingers attached to a first mounting plate with each finger holding an intermediate blade being on another first mounting plate that is longitudinally separated from the other first plate on the frame. The pattern repeats for the second mounting plates with blades from the second frame.

20 Claims, 15 Drawing Sheets

BLADE GUIDE FOR A BLADE SCREEN

FIELD OF THE INVENTION

This invention relates to a blade guide, and more particularly, to a blade guide used in conjunction with a blade screen suitable for use in sorting wood chips by size, as is done in making pulp for paper production.

DESCRIPTION OF THE PRIOR ART

Wood fiber is the basic ingredient used in paper production. Although other types of fibers may also be used, more than half the fiber that is used in paper manufacture comes from trees that are cut specifically for the production of pulp. These trees are cut into logs that are reduced to pulp either by being mechanically ground into pulp or by being chipped and cooked in a chemical solution. Chemically digested wood chips generally result in a higher quality paper than does mechanically ground pulp.

Two common processes are used to chemically reduce wood chips into pulp. The sulfite process, and the sulfate, or kraft, process. In both of these processes, lignin is dissolved under heat and pressure in a digester, resulting in the separation of cellulose fibers. Processing time may be as long as 12 hours, depending upon the size of the chips and the quality of the product desired. Processing chemicals, particles of undigested wood, and foreign materials are then removed, and the pulp is further processed into paper.

The amount of processing time required depends upon the thickness of the wood chips used. Thicker wood chips require a greater time for the processing chemicals to penetrate and dissolve their lignin, and thus require a longer processing time to digest completely. Otherwise, the undigested part of the thicker chips would have to be mechanically treated, resulting in an inferior product. Therefore, to ensure uniform processing time and paper quality, wood chips are sized before they are processed, with thicker wood chips being removed prior to pulping.

To sort wood chips, the chips are dumped onto a screen of a wood chip sorter having openings through which essentially only chips smaller than a preselected thickness may pass. The chips are then agitated, causing essentially all of the thinner chips to pass through the screen. The thicker chips may be sliced to the correct thickness, used in other ways or for other purposes, or discarded.

Several types of prior art screens are known. One of these, shown in FIG. 1A, uses pairs of spiral rolls 300 to separate wood chips of various sizes. In operation, wood chips are dumped onto the rotating spiral rolls, the rolls rotating in the directions indicated by arrows A and B. Chips are brought into the open area 302 between the rolls by this rotation, and chips thin enough to fall into the gap are collected for processing under the screen. Meanwhile, because of the spiral motion of the threads, thicker chips are brought forward as indicated by arrow C. Eventually, they reach the end of the gears and at that point may be collected or discarded. Typical dimensions of the rolls 300 are such that the open area between the rolls is only 7.9% of the total cross-sectional surface area, resulting in relatively low capacity.

A second type of prior art screen is shown in FIG. 1B. This screen comprises an array of hubs 304 and disks 306 on parallel, spaced-apart shafts (not shown). Because of the rotation of the shafts in directions indicated by arrows D and E, wood chips are brought into the region of intermeshed disks 307, where thinner chips fall through and are collected.

Thicker chips remain on the screen, and must eventually be removed. The net open area for a typically dimensioned screen of this type is 20.9%. Therefore, this screen typically has greater capacity than that shown in FIG. 1A, but still has substantial room for improvement.

A third type of screen is shown in FIG. 1C. This screen is similar in operation to that shown in FIG. IB, except that the intermeshed hubs 304A and disks 306A vary in size along the lengths of the shafts. The typical net open area is 25.1%.

A fourth type of prior art screen is shown in FIG. 1D. This screen comprises a series of parallel, elongated rectangular metal bars 308. An open area 310 of predetermined size separates adjacent bars 308 to permit sufficiently thin wood chips to fall through for collection. The spaced-apart bars are held together by frame supports at each end. Agitation is provided by shaking the entire frame assembly. This type of screen typically provides the greatest percentage open area (37.1%–49.6%) of the prior art screens discussed above.

Because papermaking is a continuous process, the rate at which the thinner chips pass through the screen has proven in many circumstances to be a bottleneck that limits the rate at which paper can be produced in a given production line. Increasing the percentage open area increases the capacity of the screen and, therefore, alleviates the effects of this bottleneck. Unfortunately, it is difficult to increase the percentage open area in the prior art screens.

For FIG. 1D, the best way to increase the percentage of open space in the screen is to reduce the width of the bars because the gap size is determined by the maximum acceptable wood chip thickness. Screens comprising relatively thin, tensioned blades instead of bars are used, wherein such blades form a screen with a substantial percentage of open space. Often, this type of wood chip sorter is a dual-frame screen, in which alternate blades are supported on different frames (one inside the other). The frames move relative to one another to impart sufficient agitation to the wood chips to ensure efficient separation. This motion is imparted by moving the frames in a reciprocating motion relative to one another.

However, some wood chips, particularly wedge-shaped chips, tend to become lodged between the blades of the dual frame screen. Stuck chips generate pressures against the blades that tend to deform them unless they are sufficiently sturdy. It is, therefore, necessary to periodically stop the feeding of chips to prevent the screen from becoming clogged. This reduces the efficiency of the screening operation.

These chips can bend the thin blades out of shape, thereby distorting the blade gap. It is therefore desirable to provide a blade guide that provides support to avoid deformation and ensures accurate spacing of the blades. It is also desirable to minimize movement and vibration of the blades to ensure accurate screening of the materials.

An example of a blade guide is a spacer comb briefly discussed in U.S. Pat. No. 5,398,819 issued to Cormack et al. on Mar. 21, 1995. Such a blade guide is a comb device that is fixedly attached to one frame of the wood chip sorter. The blades that are stationary relative to that frame are restricted by the comb from vertical movement relative to the comb device. The blades of the other frame that move relative to the spacer comb travel in an elongated vertical slit. This provides lateral support for the moving blades. The wood chip sorter can also use a second spacer comb that is fixedly attached to the opposite frame and has a similar design.

Guides for blades in the prior art, however, have a tendancy to accumulate a build up of wood ribbons or fines in the bottom of the elongated vertical slits that receive the moving blades. These ribbons or fines can interfere with the efficient operation of the screen causing, among other problems, lateral instability and high wear on the blade guide. The resulting build up can also deform a blade or create stresses that can shear the pins that hold and tension the blade within the frame. These stresses have even caused the blades to break. It is thus desirable to prevent the build up of such waste material as well as to provide a means to remove any debris before a build up occurs.

The blade guides must also ensure that the relative motion between the frames is unhindered in a dual-frame screen. It is, therefore, desirable to provide a blade guide that works in conjunction with the frames and relies on the movement of the frames to remove any fines that may start to accumulate therein.

SUMMARY OF THE INVENTION

The disadvantages of the prior art are overcome by the present invention which provides a blade guide for a blade screen comprising a plurality of fingers through which the blades of the screen are disposed. These fingers are fixedly attached to a plurality of mounting plates for each frame. The fingers on each mounting plate are separated from each other at a distance so that at least one blade from the same frame, and the associated adjacent blades from the opposite frame, are between the adjacent fingers on each mounting plate. The resulting area that exists between the fingers on each mounting plate prevents the fines and ribbons from accumulating, thus avoiding the prior art problems.

It is preferred that all of the blades of each frame are disposed through at least one finger in each blade guide. Fingers having adjacent blades of the same frame disposed therethrough are fixedly attached to different mounting plates. These mounting plates are longitudinally separated from each other by a distance sufficient to ensure that the build up of material is hindered, if not completely avoided.

The present invention has other advantages. Prior art blade holders allowed vertical "whipping" movement of the blades. Increasing the tension of the blades usually failed to stop this blade action because an impracticable blade tension would be required. The present invention can limit this "whipping" action if the blade guides are placed, at a minimum, in the middle of the blade screen. This improvement in the control of the blades results in a more stable screening surface. As a result, more energy from the eccentric movement of the blades is transferred to the wood chips, improving the performance of the screen.

The blade guides of the present invention also increase capacity by potentially allowing more materials to be continually placed on the screen or by allowing the blade screens to be longer in length. And, when processing chips at close to the maximum capacity with the prior art blade screens, vertical movement of the chips would be diminished. The blade guide of the present invention enables good agitation of the chip layer to be maintained, resulting in improved screen capacity. In addition, the present invention provides improved guidance of the blades over the prior art.

The blades are preferably provided with a saw-tooth bottom which cuts into smaller particles the ribbons or wood fines that may begin to accumulate in the blade guides, thus preventing their build up in the blade guides to avoid interference with the movement of the blades. Tests have shown that the region most subject to such a build up is in the blade guides in the area formed between the blade supports (i.e., fingers). The saw-tooth detail on the blades effectively eliminates the build up of these ribbons.

It is thus an object of the invention to provide a blade guide that can effectively allow a plurality of blades to operate with minimal additional stresses caused by build up of fines. It is a further object of the invention to provide a blade guide that prevents accumulation of wood fines or ribbons therein. It is a still further object of the invention to provide a blade guide that prevents binding in a dual eccentric shaft assembly. These and other objects will become apparent to one skilled in the art upon reading the detailed description.

BRIEF DESCRIPTION OF THE FIGURES OF DRAWINGS

FIGS. 1A–D are schematic views of the top of various prior art screens. FIG. 1A shows a screen comprising worm gears. FIG. 1B shows a screen comprising an array of hubs and shafts. FIG. 1C shows a screen comprising a modified array of hubs and shafts. FIG. 1D shows a screen comprising a plurality of bars.

Figure 12A:
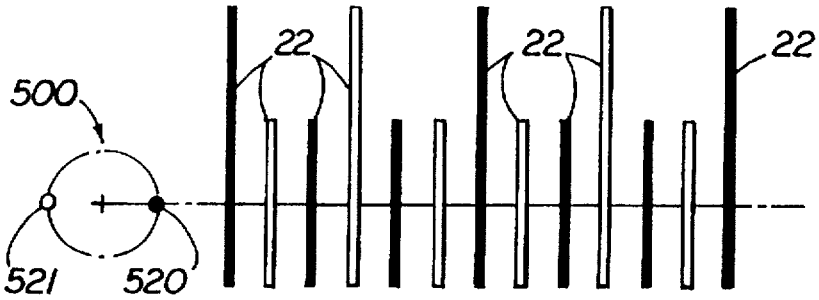

FIGS. 12A, B, and C are end view schematic representations of the reciprocating motion of blades of different heights in a blade screen.

Figure 13:
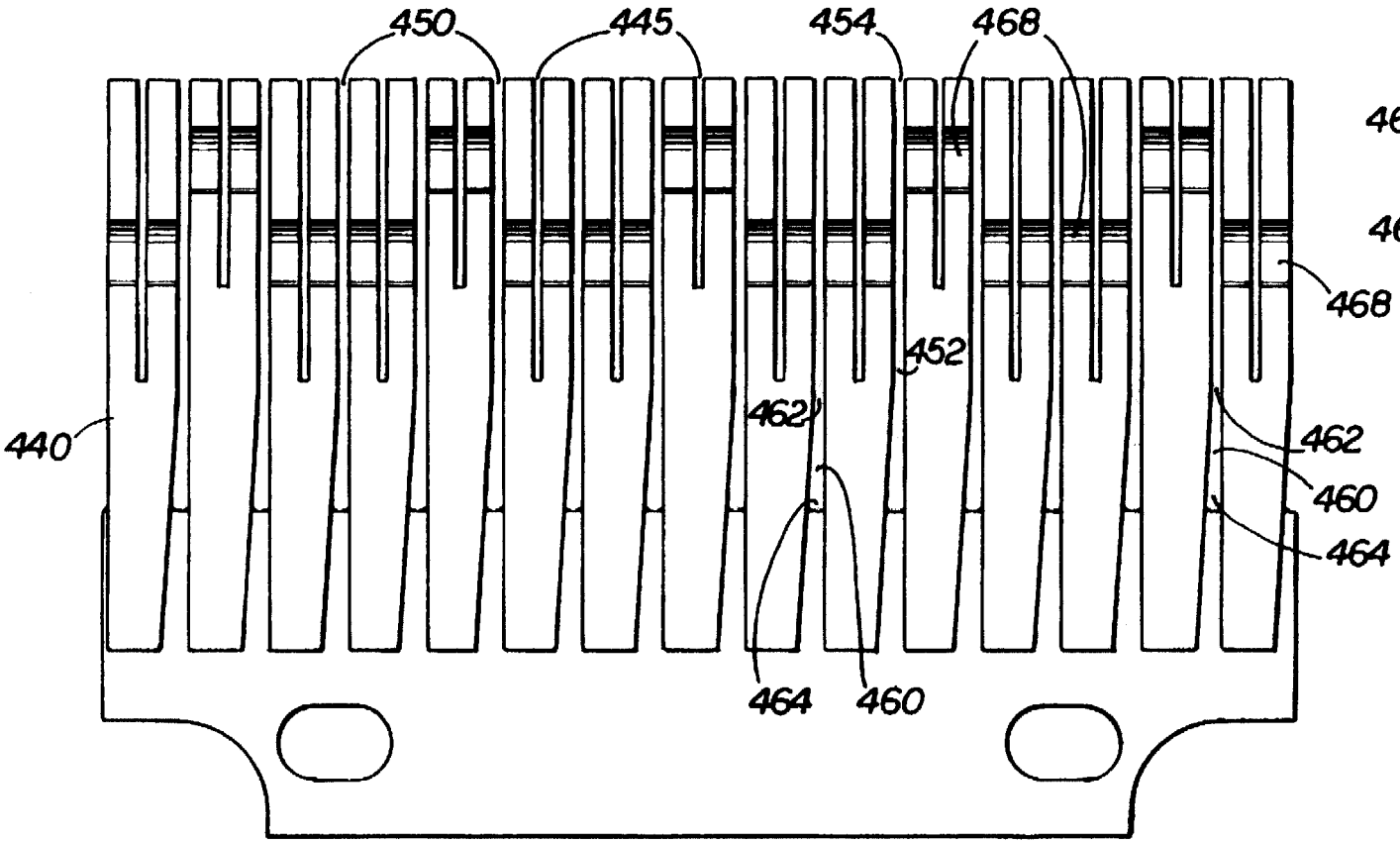

FIG. 13 is a front plan view of another embodiment of the present invention.

Figure 14:
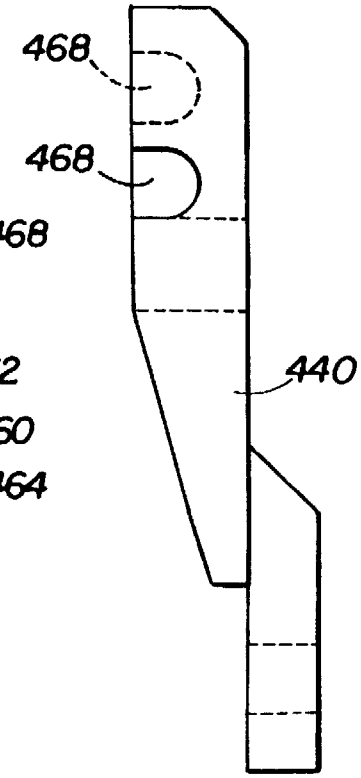

FIG. 14 is an end view of FIG. 13.

DETAILED DESCRIPTION OF THE ILLUSTRATIVE EMBODIMENTS

The present invention is more particularly described in the following description that is intended as illustrative only since numerous modifications and variations will be apparent to those skilled in the art.

As used in the specification and in the claims, "a" can mean one or more, depending upon the context in which it is used.

Figure 1A:
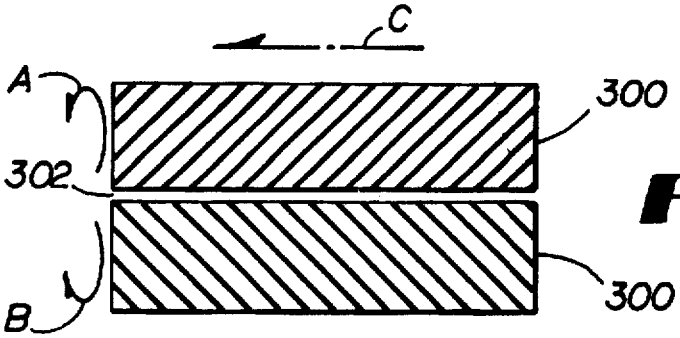
FIG 1A PRIOR ART
Figure 1B:
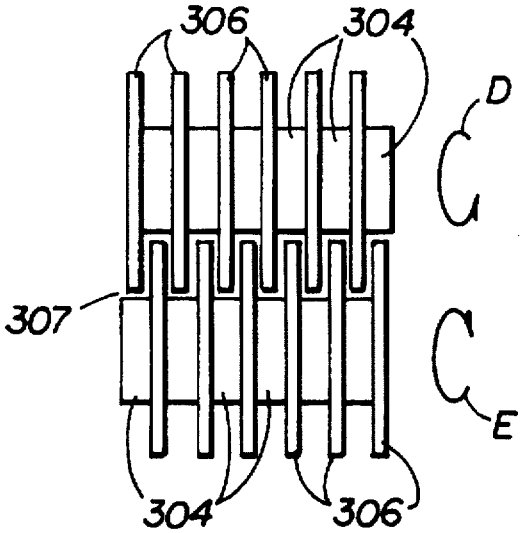
FIG 1B PRIOR ART
Figure 1C:
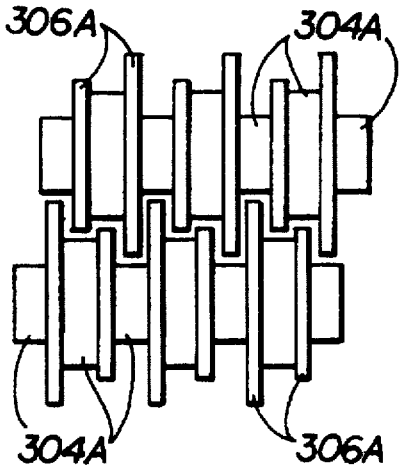
FIG 1C PRIOR ART
Figure 1D:
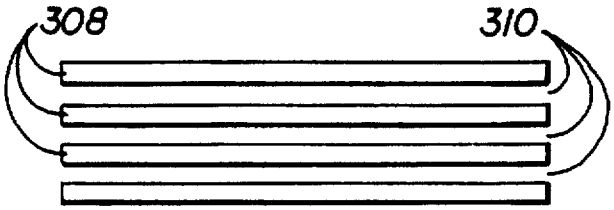
FIG 1D PRIOR ART
Figure 2A:
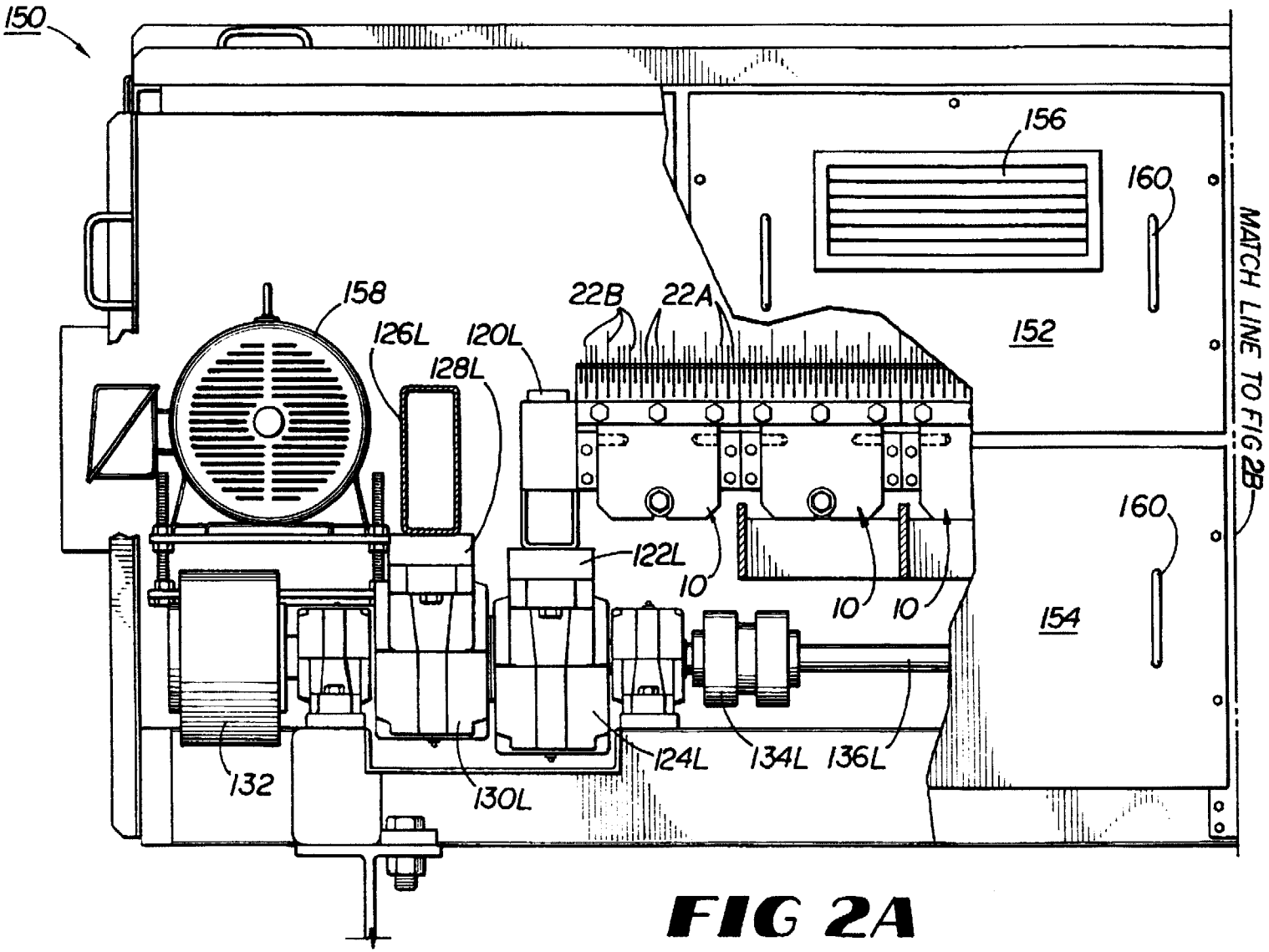
FIGS. 2A and 2B are cut-away front views of different sections of a blade screen separator.
Figure 2B:
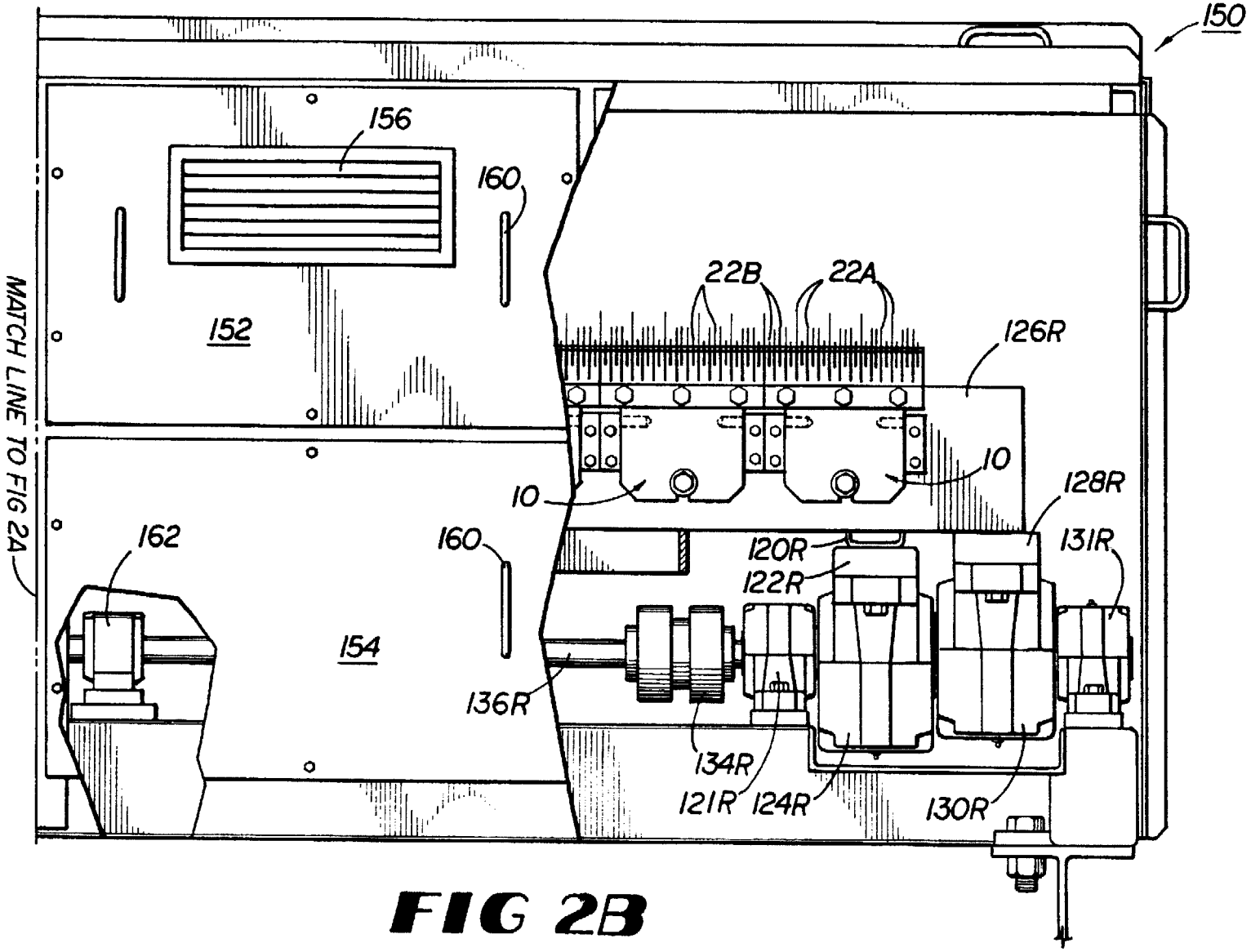

To appreciate the present invention, it is beneficial to discuss the design and operation of a dual-frame sorter with which the blade guide is used. Referring now to FIGS. 2A and 2B, which together form a staggered, cut-away front view, and also FIGS. 3A and 3B, which together form a staggered, cut-away side view, a wood chip separator 150 is shown. For clarity of illustration, and to provide a more detailed view of the invention and its relationship to the other components in the separator, the drawing of the front view of the separator has been divided into two sections, FIGS. 2A and 2B, that are to be joined along the indicated match line. The side view has similarly been divided into two sections, FIGS. 3A and 3B, which are also to joined along an indicated match line. The wood chip separator 150 is enclosed on all sides by a combination of vented panels 152 and unvented panels 154. Vents 156 provide air circulation for the electric motor 158 inside. The vented and unvented panels 152, 154 may be removed with the aid of handles 160 to access the internal parts.

Right side components are identified by an "R" suffix for the reference numerals, corresponding to the "L" suffix for the left. FIG. 2A shows interleaved blades 22A and 22B in relationship to one another in this end-on view. These blades are used for sorting the wood chips. Journal 162 for shaft 136 is also shown in FIG. 2B. Side member 120L of the inner frame is mechanically coupled to an eccentric journal 122L, which is part of a conventional crankshaft and bearing assembly 124L. Side member 126L of the outer frame is mechanically coupled to another eccentric journal 128L, which is part of another conventional crankshaft and bearing assembly 130L. Crankshaft and bearing assemblies 124L, 130L are coupled to a shaft 136, which may actually comprise a number of sections joined by one or more flex couplings 134L. The shafts are rotated by electric motor 158, through additional shafts 136L and couplings 134L, and right angle reducer 132. A similar arrangement on the right side of the frame is shown in FIG. 2B, where the cut-away section is arranged to show the blade tensioning assemblies 10 disposed on the outer frame. The eccentric journals 122L, 128L, 122R, and 128R, together with other similar assemblies at the rear of the inner and outer frames, impart a coordinated, complementary reciprocating motion to the inner and outer frames in a plane parallel to the flat surfaces of blades 22A and 22B when motor 158 is energized. This motion agitates wood chips placed on top of the screen formed by the various blades 22A, 22B.

Figure 3A:
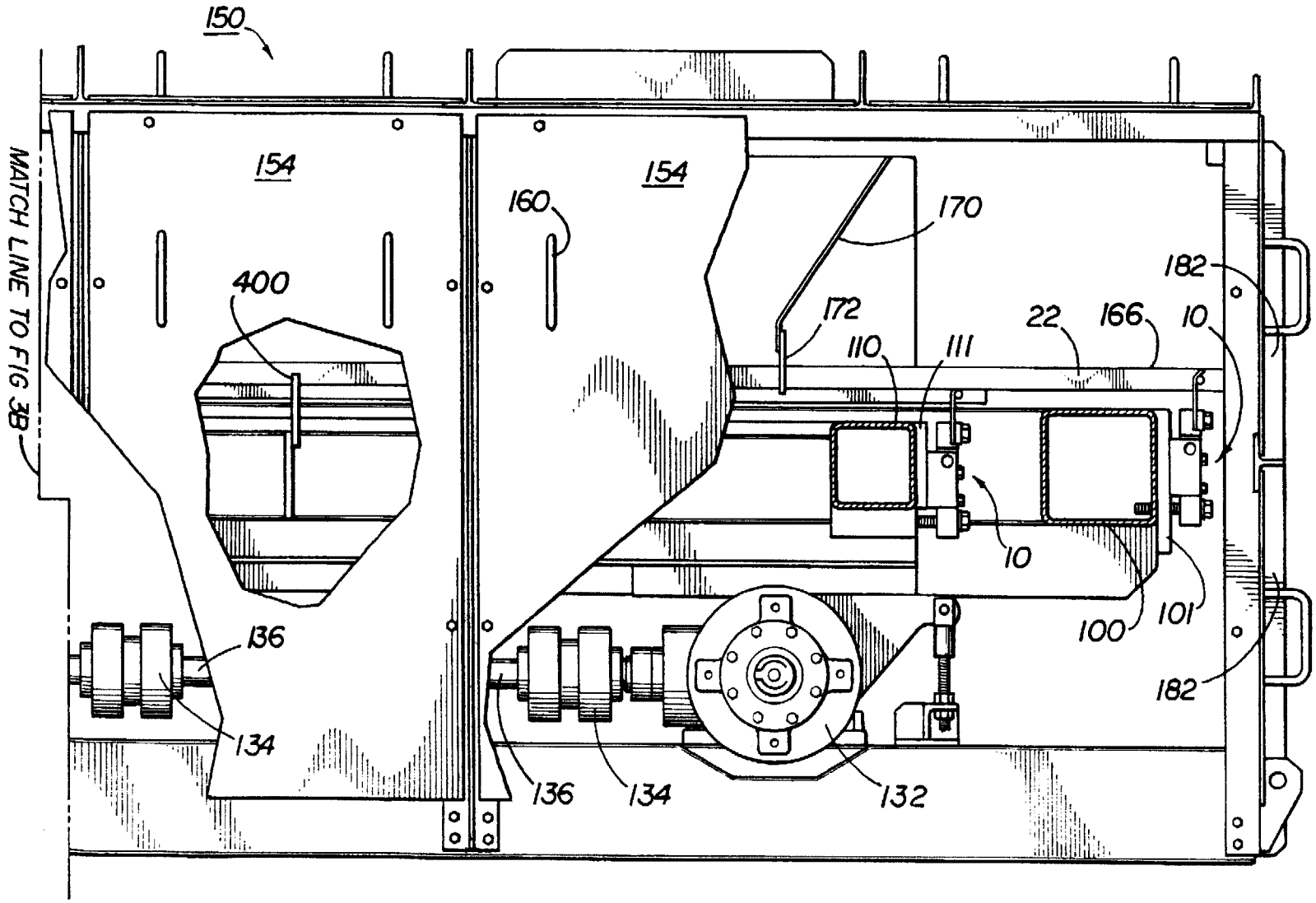
FIGS. 3A and 3B are cut-away side views of different sections of the blade screen separator of FIGS. 2A and 2B.
Figure 3B:
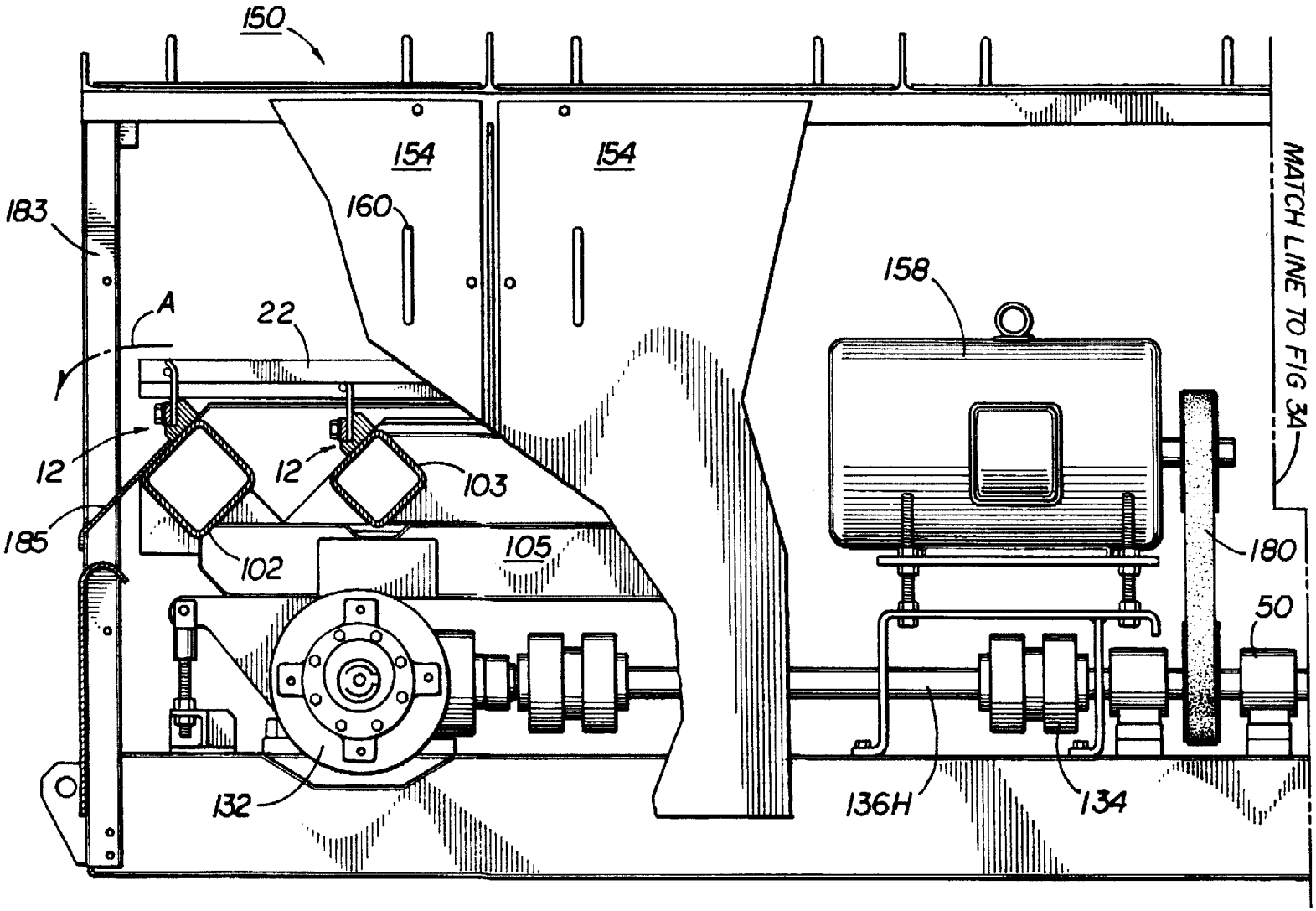

Electric motor 158, better shown in FIG. 3B, is coupled by belt 180 to a high speed shaft 136H. Flex couplings 134 are provided in high speed shaft 136H to simplify servicing of shaft 24. Conventional right angle reducers 132 couple the motion of shaft 136H to the low speed shafts 136 in the front and rear of chip sorter 150. The low speed shaft 136 in the front of the chip sorter 150 is shown in FIGS. 2A and 2B, and is coupled to the eccentric journals 122L, 122R, 128L, 128R. Additional coordinated eccentric cranks (not shown) are provided in corresponding positions at the rear of chip sorter 150 for the same purpose. Power is supplied to the cranks at the rear of chip sorter 150 by means of a shaft (not shown) at the rear of the sorter coupled to a right angle reducer 132.

In operation, wood chips are fed from a wood chipper (not shown) into chip sorter 150 from the top at a point some distance inward from the front panels. A chute or baffle 170 is preferably provided for this purpose and to prevent wood chips from impinging on the front panels 182 or from falling off the edge of the screen near the front panels 182. The bottom end of baffle 170 is provided with a spacer comb 172, the sides of which are mounted to inner frame members; thus, baffle 170 moves relative to the outer frame. The spacer comb 172 permits the blades 22 (one of which is shown lengthwise in FIG. 3A) to reciprocate within its slots, while preventing stray chips from working their way towards the front of the chip sorter near front panels 182. The reciprocating motion of one set of blades 22A relative to the other set 22B encourages smaller wood chips to fall between the blades into a collector (not shown). Larger wood chips that do not fall through are essentially shaken out towards the rear 183 of separator 150, where an outflow of "overs" occurs as indicated by arrow A. A baffle 185 is preferably provided to guide this flow out of the open rear end of the sorter. The overs may be reprocessed into smaller chips, discarded, or used for other purposes. The portions of the inner frame 103 and outer frame 102 nearest the rear 183 of the chip sorter 150 preferably do not present horizontal surfaces at their top. Such a horizontal surface might tend to accumulate chips on its top and thereby impede the outflow of overs, thus slowing the sorting process.

A blade guide 400 of the present invention is shown schematically in FIG. 3A. In general, blade guide 400 assists in preventing blades 22 from being bent out of shape, thereby distorting the blade gap, if chips having odd shapes and sizes (particularly wedge-shaped chips) become caught between blades 22. Thus, clogging or ruining of the screen is effectively prevented and the quality and efficiency of chip thickness is assured.

Blades 22 are preferably made of sawblade material such as 1080 carbon steel that has a minimum thickness of 0.023 inches or 1.5 millimeters to ensure that the proper tension can be provided on the blades 22 and that the blades do not deform easily if odd-shaped wood chips become stuck between them. The blades 22 should also be thin enough to permit tensioning without excessive torque being required. The lateral spacing between blades 22 is determined by the wood chip size requirement and is, of course, affected by the thickness of the blades 22.

Figure 4:
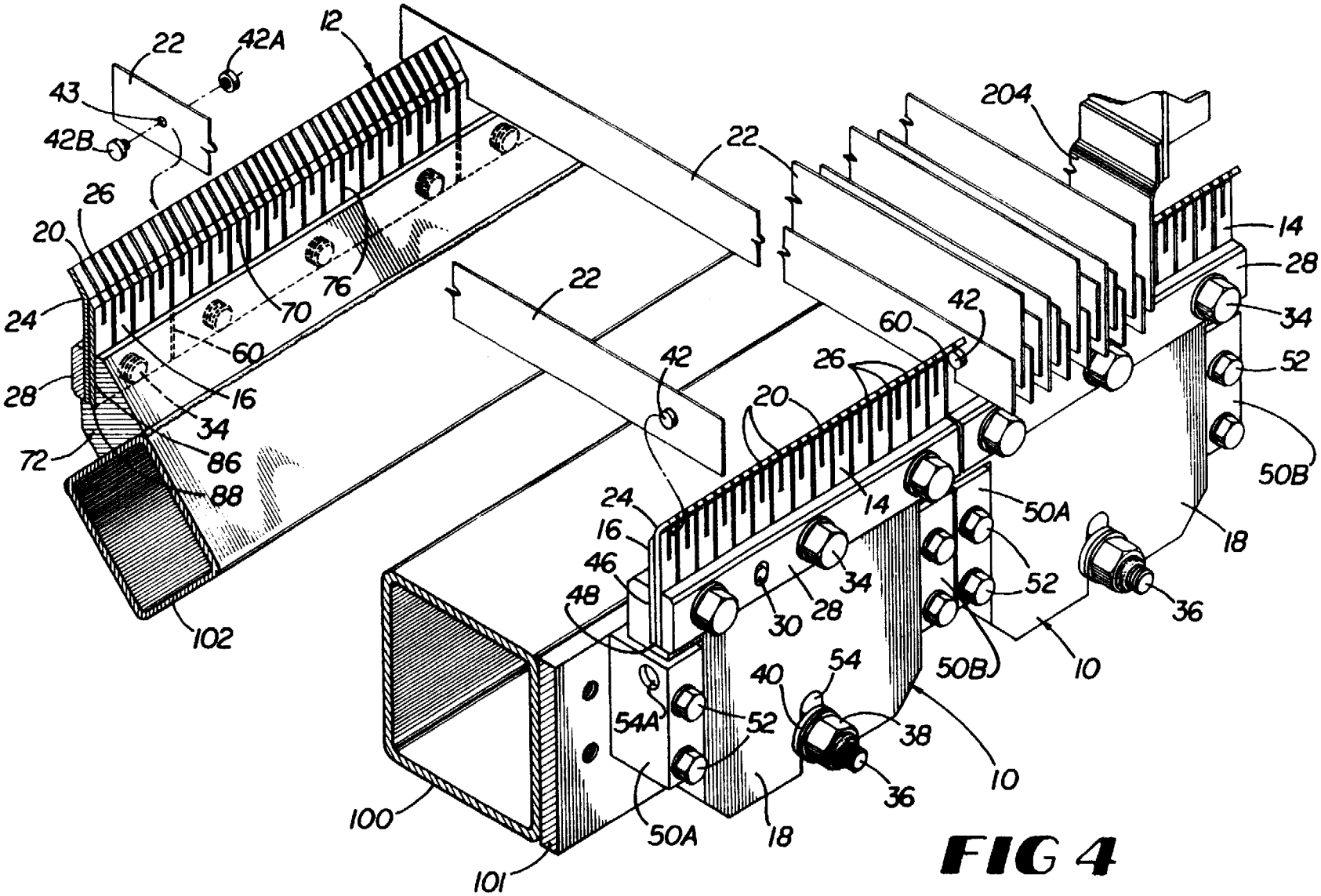
FIG. 4 is a perspective view of a portion of a blade screen tensioner, showing the relationships between the blades and one of the frames comprising the screen.

Turning now to FIG. 4, a tensioning device 10, 12 for a blade screen is shown. The front assembly 10 of the tensioning device has a steel spring blade holder 14, a reinforcing comb 16, and a bracket 18. Blade holder 14 and reinforcing comb 16 are fixedly attached to bracket 18. A clamp 28 presses both blade holder 14 and reinforcing comb 16 against a recessed face 46 of bracket 18. The flat, straight bottom edges of blade holder 14 and reinforcing comb 16 are fixed against a bottom wall 48 of the recessed region. Bolts 34 are threaded into clamp 28, blade holder 14, reinforcing comb 16, and recessed face 46 to hold blade holder 14 and reinforcing comb 16 in place. An alignment pin 30 aligns the blade holder 14 and reinforcing comb 16.

Blade holder 14 has a series of spaced-apart vertical slots 20 alternating with longer, spaced-apart vertical slots 26. Neither slots 20 nor slots 26 extend into the clamped region between recessed face 46 and clamp 28 which permits each section of blade holder 14 and reinforcing comb 16 to be handled and secured as a unit.

Slots 20 are dimensioned to allow separate blades 22 to be placed therein. Reinforcing comb 16 also has a similar series of vertical slots of alternating length (70, 76, not shown in conjunction with front portion 10, but better seen at rear portion 12 of the tensioning device), which are aligned with and are essentially same length as slots 20 and 26 in blade holder 14. Slots 20 permit tensioning by the tensioning device 10. Vertical slots 26 are dimensioned to allow blades tensioned on different frame to pass therethrough, and to permit relative movement between the two frames. If more than one bracket 18 is used, the brackets 18 should be separated so that a space 60 equivalent to a slot 26 exists between the blade holders 14 and reinforcing combs 16 affixed to adjacent brackets 18.

Bracket 18 itself is held in place between a pair of hinge sections 50A, 50B, which is stationarily affixed to a frame member 100 (or an optional attachment plate 101 affixed to the frame member) by any suitable means, such as by bolts 52. A dowel 54A is provided through a hole in the hinge sections 50A, 50B to allow bracket 18 to pivot about the axis of the dowel. Bracket 18 has a slot 54 to accommodate a stud 36 affixed to front frame member 100 (or attachment plate 101). An elastic stop nut 38 on stud 36 holds bracket 18 in place against the tension of a plurality of blades 22, preferably in conjunction with spherical washers 40.

Rear frame member 102 (which is the rear of the frame comprising front frame member 100) has a separate, fixed rear tensioning assembly 12. Rear tensioning assembly 12 has a fixed rear mounting bracket 72 affixed to rear frame member 102. Rear mounting bracket 72 has surfaces 86, 88 corresponding to recessed face 46 and wall 48, respectively, of front bracket 18 for mounting blade holders 14 and reinforcing combs 16 thereto using brackets 28 and bolts 34 or any other suitable mounting means.

Blade holders 14 and reinforcing combs 16 on the front assembly 10 and rear assembly 12 are aligned so that each blade 22 is inserted into corresponding short slots 20, and interleaved blades affixed to another screen (not shown) pass through slots 26. The blade holders 14 and reinforcing combs 16 of the rear assembly 12 may be identical to those in front assembly 10.

Blades 22 have press-fit snaps 42 to engage blade holders 14 in both the front and rear assemblies 10, 12. A press-fit snap having two sections 42A, 42B is shown at the rear of blade 22 in FIG. 4. The snap 42 fits through a hole 43 in the blade. Hole 43 is positioned so that the blade 22 rests at the bottom of a short slot 20, while the snap 42 engages blade holder 14 in a short slot 20 at bend 24. Bend 24 is at an angle to prevent the snap 42 from riding up the slot 20 or deforming the blade holder 14 around slot 20. The bends 24 of the front and rear tensioning assemblies 10, 12 are directed in opposite directions, away from one another, so that, motions tending to cause a blade 22 to migrate upward cause the spring blade holder 14 to redirect the blade downward into its respective slot 20.

Figure 5:
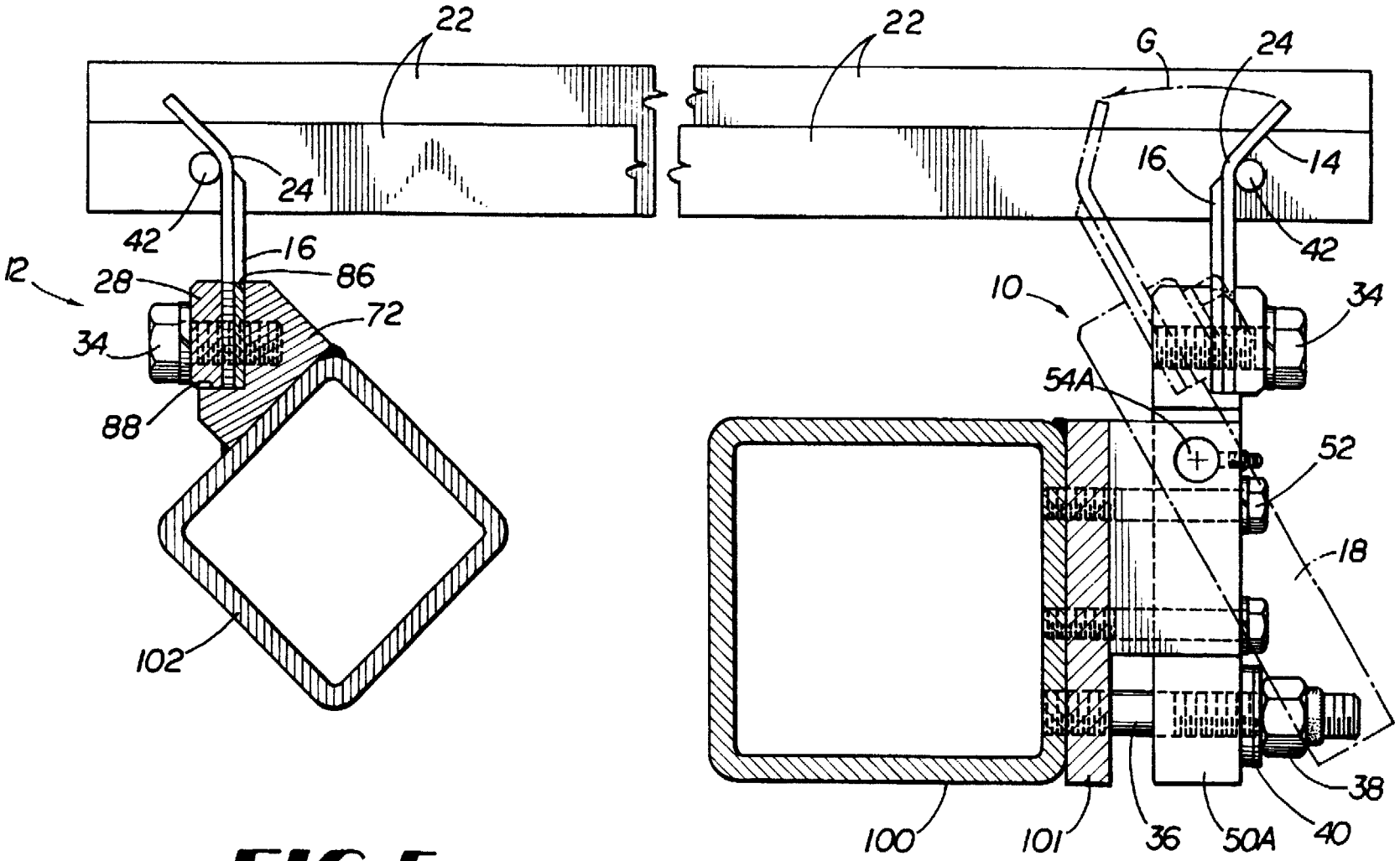
FIGS. 5 is a side view of a portion of a blade screen tensioner showing the operation of the tensioning mechanism.

A side view of the blade tensioning device is illustrated in FIG. 5. Because slots 20 are aligned between the front and the rear tensioning assemblies 10, 12, blades 22 (which show blades of alternating height) are inserted into position by pivoting bracket 18 into its open position as indicated by the phantom lines and arrow G. Bracket 18 is then returned to its closed position, and elastic stop nut 38 is tightened on bolt 36 which causes the spring blade holders 14 on front and rear tensioning assemblies 10, 12 to pull on snaps 42, thereby tensioning blades 22.

Figure 6:
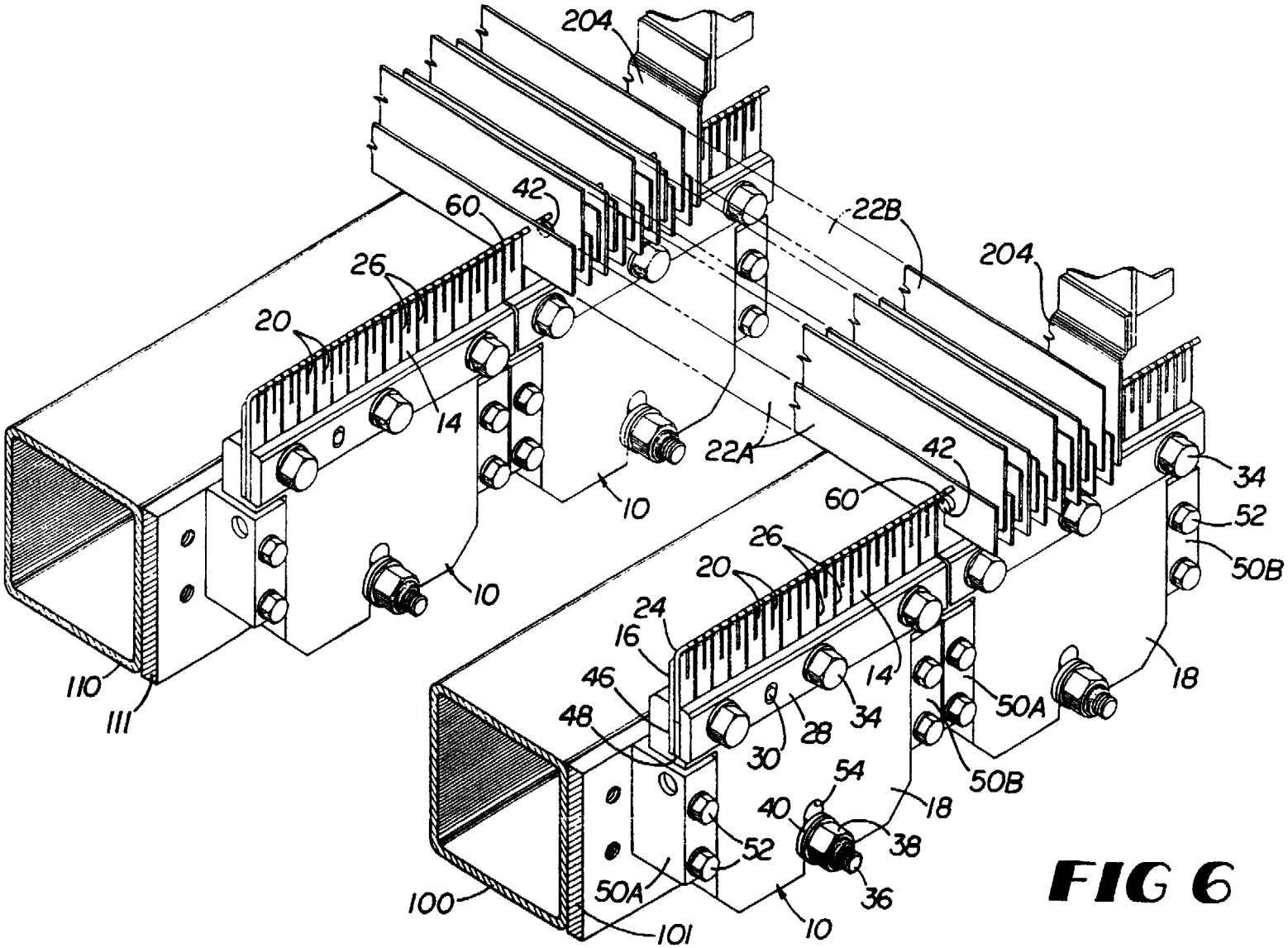
FIG. 6 is another perspective view of a portion of a blade screen, showing the inner and outer frames of the screen and their relationship to one another and to the blades themselves.

FIG. 6 shows a view of the front members 100, 110 of an outer and an inner frame having attachment plates 101, 111, respectively, affixed thereto. Alternating blades 22A, 22B have snaps 42 disposed at different positions along their length, so blades 22A may be held in place by tensioning assemblies 10 on the inside front frame member 110 and blades 22B may be held in place on the outside front frame member 100. Each blade 22A, 22B is long enough so that all of the blades extend across the entire length of the outer frame assembly. The slots 20, 26 in front tensioning assemblies 10 are aligned so that a blade 22A engaged in a short slot 20 in a tensioning assembly 10 on inner front frame member 110 passes through a long slot 26 (or an equivalent slot 60 between two tensioning assemblies) in a tensioning assembly 10 on outer front frame member 100. Similarly, a blade 22B engaged in a short slot 20 in a tensioning assembly 10 on outer front frame member 100 passes through a long slot 26 (or an equivalent slot 60 between two tensioning assemblies) in a tensioning assembly 10 on inner front frame member 110. Because the flat faces of each blade 22A, 22B are in a vertical plane, and because long slots 26 are vertically disposed, the inner and outer frames thus may move relative to one another to agitate wood chips placed on a screen comprised of the interleaved blades.

As shown, each front and rear tensioning assembly 10, 12 provides space for fifteen blades 22. The tensioning assemblies 10, 12 may be modified to accommodate a greater or lesser number of blades.

Still referring to FIG. 6, fixed fences 204 (only one of which is shown) are used on each side of the screen to prevent wood chips from exiting the sides of the screen rather than going through it. The fixed fences 204 extend the entire length of the screen and are supported by attachment to a portion of the separator structure (not shown).

The preferred embodiment of the present invention, shown in FIGS. 7–11, is a blade guide 400 that is used in a dual-frame wood chip sorter that has a first frame and a second frame. As used herein, the "first frame" can refer to one of either the inner frame or outer frame and the "second frame" refers to the other respective frame. Each frame of the dual-frame wood chip sorter has a front frame member 100, 1 10, an opposite rear frame member 102, 103, two opposing, longitudinally extending side frame members 105, a plurality of longitudinally extending blades 22, and at least one longitudinally extending support member 107 disposed below the blades 22, intermediate the two side members 105, connected to the respective forward 100, 110 and rear frame members 102, 103. The support member 107 has a top surface 108.

Figure 9:
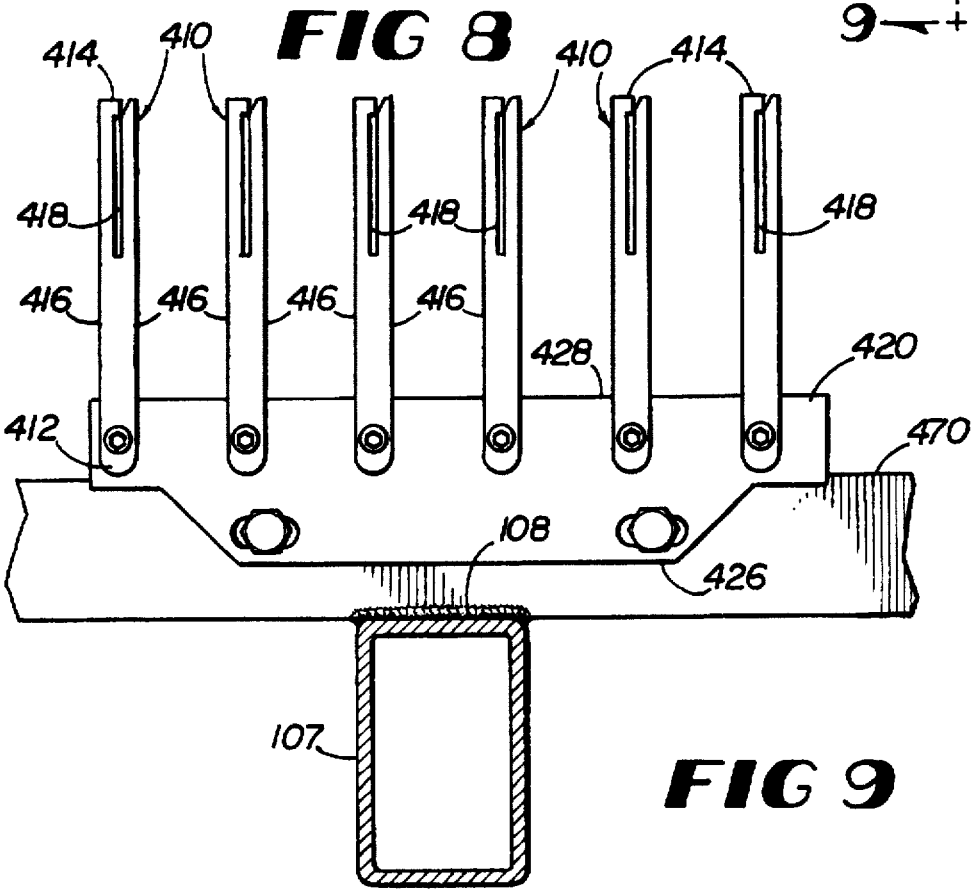
FIG. 9 is a front plan view taken along line 9—9 of FIG. 8.

The blade guide 400 of this embodiment comprises a plurality of elongated fingers 410, at least two first frame mounting plates 420, and at least two second frame mounting plates 422. As best shown in FIG. 9, each finger 410 has a bottom end 412, an opposite top end 414, two opposing edges 416, and a slot 418 therethrough intermediate the two edges 416 of the finger 410. The fingers 410 are preferably made of 1080 carbon steel or the like.

The slot 418 of each finger 410 is of a size to receive therein one of the blades 22. The slot 418 is preferably laser cut to ensure precise alignment of the blade 22 therein. The fingers 410 as shown have a opening to allow the blades 22 to be snapped into place in the slot 418 and retained to prevent vertical movement of the blade 22. If a blade is to be removed, the top of the finger 410 can be pried opened to remove the blade 22. Alternatively, the top 414 of the finger 410 can be welded or riveted onto the finger 410 to form a permanently closed slot 418. The fingers 410 allow horizonal adjustment of the blades 22, as required to maintain the appropriate tension, but restrain vertical movement. This provides a more stable array of blades 22.

There are at least two first frame mounting plates 420 and at least two second frame mounting plates 422 in the blade guide 400. The first frame 420 and the second frame mounting plates 422 preferably have the same design for manufacturing considerations. Therefore, any mounting plate shown in FIGS. 8–11 can be representative of mounting plates for either frame. However, other mounting plate designs are contemplated. For example, the mounting plates 420, 422 can be longer or shorter, depending upon the number of support members 107 to which the mounting plates can be fixedly attached.

Figure 7:
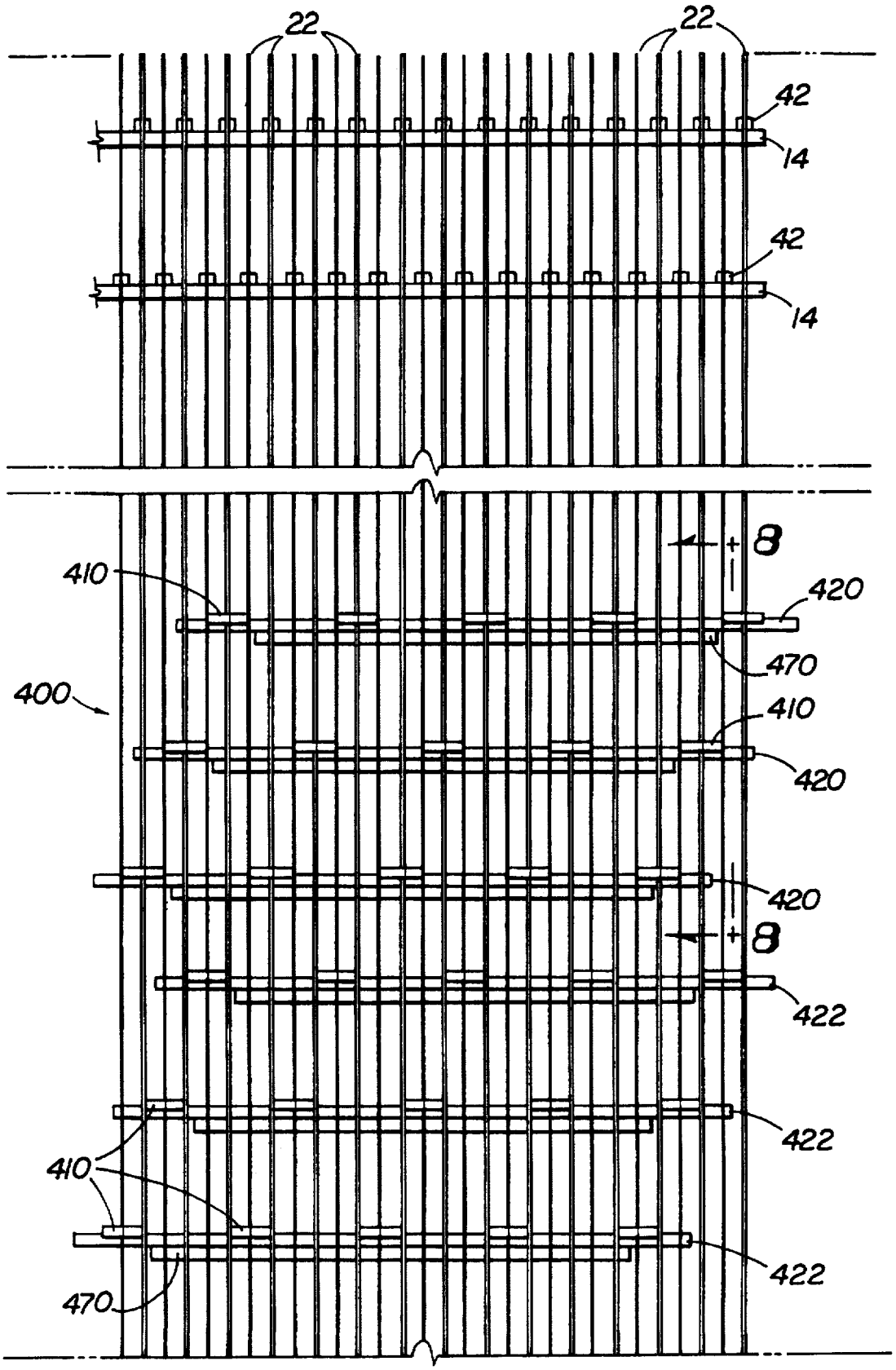
FIG. 7 is a top plan view of one embodiment of the present invention, showing one blade guide integrated into the blade screen.
Figure 8:
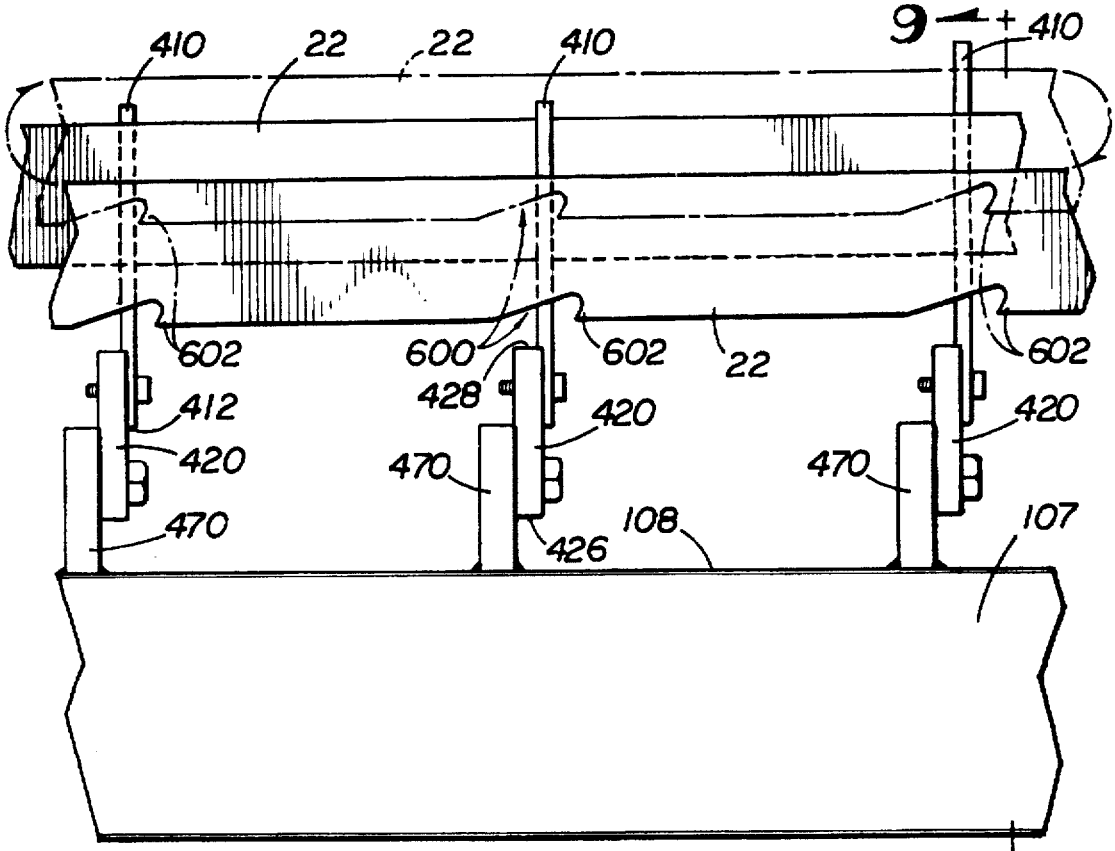
FIG. 8 is a side elevational view taken along line 8—8 of FIG. 7, showing one section of the blade screen for one frame and a blade from the other frame moving relative thereto.

As best seen in FIGS. 8 and 9, each first frame mounting plate 420 has a lower end 426 fixedly attached to the top surface 108 of the support member 107 of the first frame and an opposite upper end 428 fixedly attached to the bottom end 412 of at least two fingers 410. Each of the fingers 410 attached to a first mounting plate 420 has a blade 22 of the first frame disposed through its slot 418, wherein at least one blade 22 of the first frame is disposed intermediate adjacent fingers 420 attached to each first frame mounting plate 420. FIG. 7, for example, shows two blades 22 from the first frame intermediate each finger 410 that is attached to one primary first mounting plate 420. Each finger 410 that has one of those intermediate blades 22 of the first frame disposed through its slot 418 is attached to another secondary first mounting plate 420 that is longitudinally separated within the first frame from the other first mounting plate(s) 420 by a predetermined distance. This relationship is shown in FIGS. 7, 10 and 11.

The second frame mounting plates 422 for the blade screen 400 preferably have the same design and configuration as the first frame mounting plates 420. That is, each of the fingers 410 attached to each second mounting plate 422 has a blade 22 of the second frame disposed through its slot 418 so that at least one blade 22 of the second frame is disposed intermediate adjacent fingers 410 attached to one second frame mounting plate, and each finger 410 that has one of those intermediate blades 22 of the second frame disposed through its slot 418 is attached to another second mounting plate 422 that is longitudinally separated within the second frame from the other second mounting plate(s) 422 by a predetermined distance.

The predetermined distance that the respective mounting plates 420, 422 in one frame should be longitudinally separated from each other is preferably 20.32 centimeters (eight (8) inches). The minimal preferred longitudinal separation is 15.25 centimeters (sic (6) inches) and the maximum preferred separation is 25.4 centimeters (ten (10) inches), although the blade guide 400 will work with a smaller or larger longitudinal separation. In addition, adjacent first mounting plates 420 and second mounting plates 422 are preferably longitudinally separated from each other by a predetermined distance of 15.25 centimeters (six (6) inches). However, this distance is a nominal separation. The actual separation varies from 12.7 to 17.8 centimeters (five (5) inches to seven (7) inches) because the first mounting plates 420 and the second mounting plates 422 move relative to each other during operation of the sorter. Again, other separation distances will work but are less desirable. Lateral separation of the fingers 410 on a respective plate is dictated by the spacing of the blades 22 for screening chips and the number of intermediate blades 22 between the fingers 410.

Figure 10:
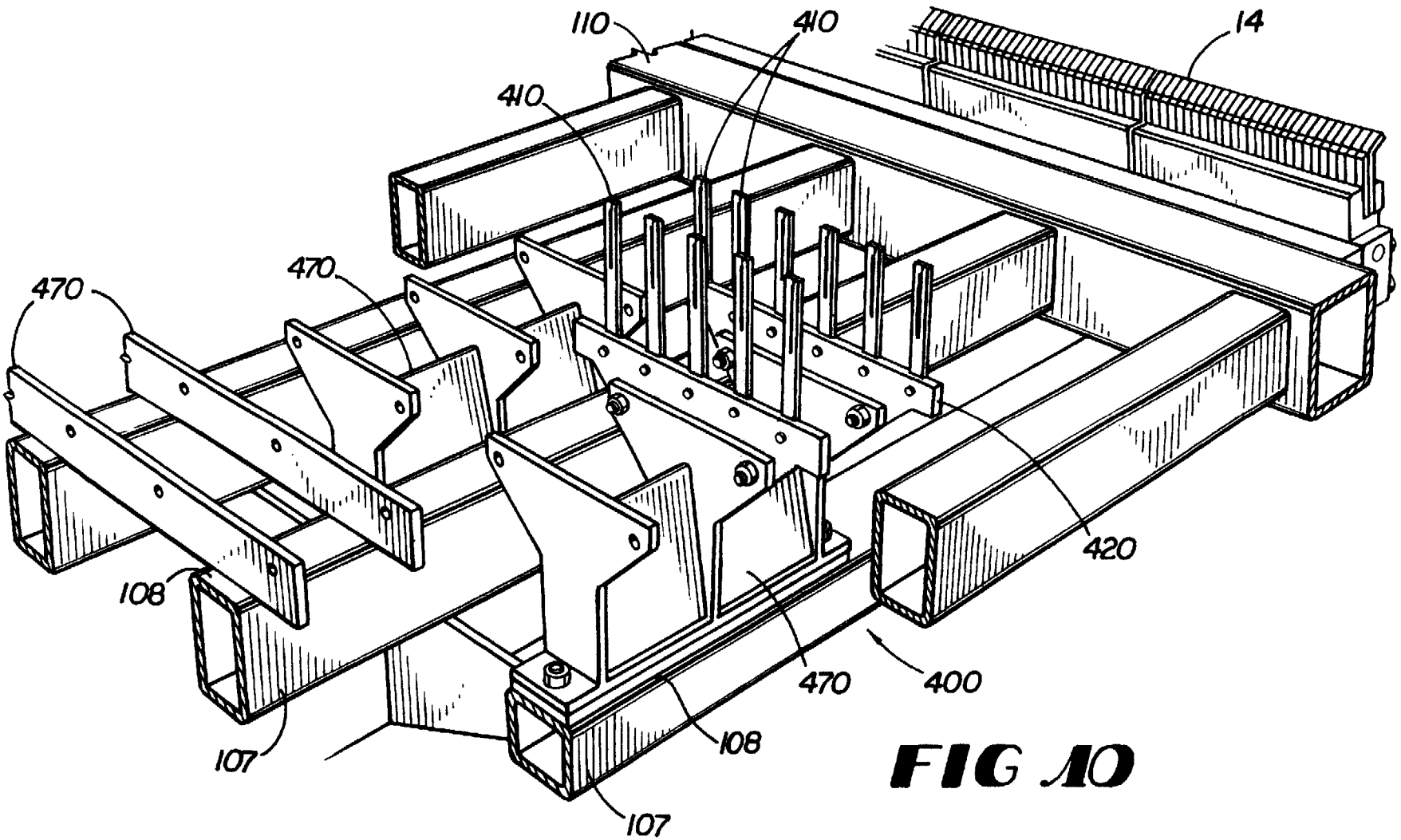
FIG. 10 is a partial perspective view of FIG. 7, showing a partially constructed blade guide of the present invention and the interrelationship of the inner and outer frames.
Figure 11:
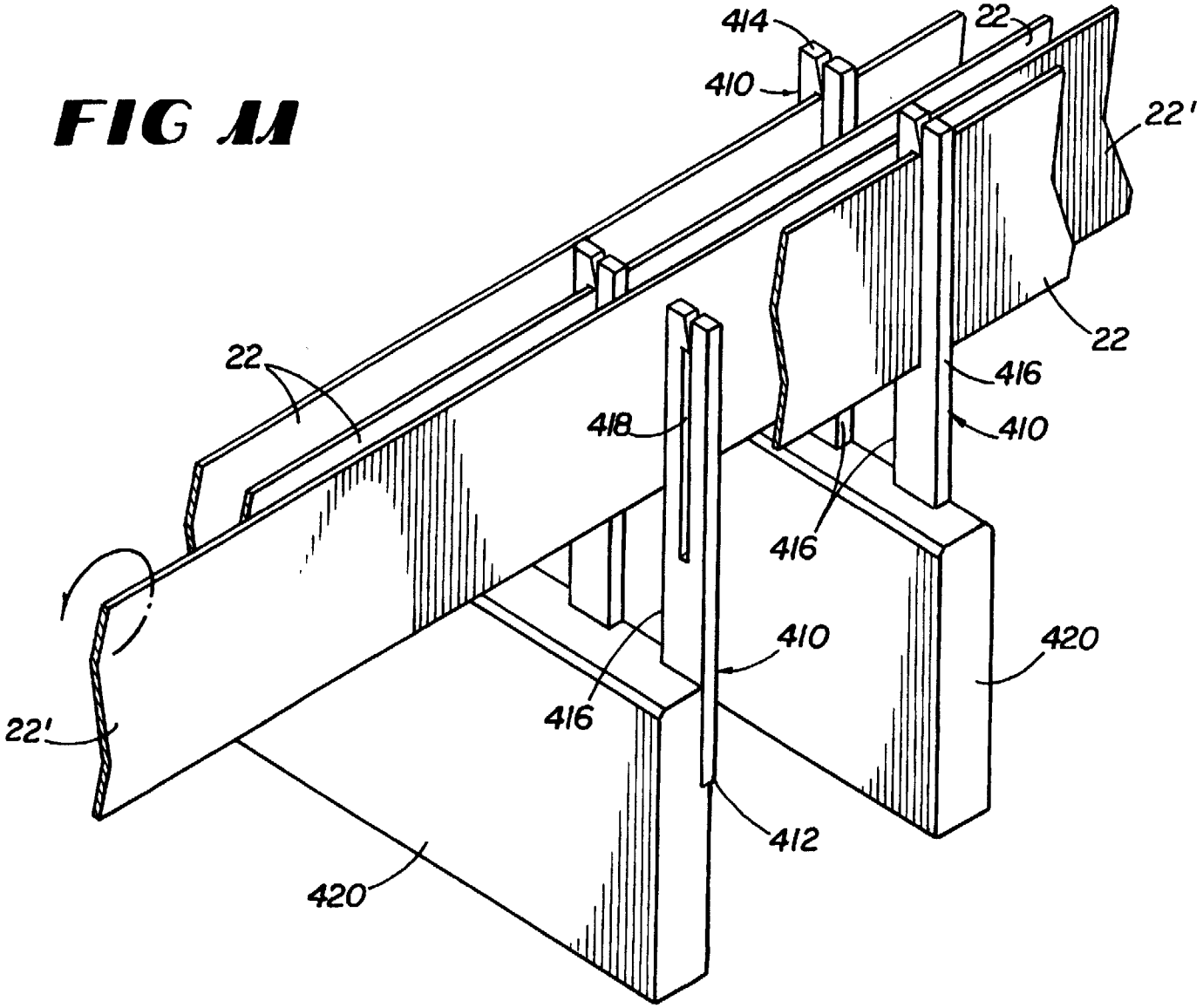
FIG. 11 is a partial perspective view of the present invention, showing the interaction of the blades from different frames.

FIG. 10 illustrates positioning members 470 that are used to interconnect the top surface 108 of the support member 107 to the lower end 426 of the mounting plate 420. Each mounting plate for the inner frame can alternately extend laterally across the inner frame, be fixedly attached on its ends to the side members 105, and not be attached to the support member 107. The outer mounting plates of the inner frame can also be fixedly attached to both one support member 107 and one side member 105.

The mounting plates 420, 422 are precision machined so that, in conjunction with the laser cut slots 418 of the fingers 410, exact placement of the blades 22 is ensured. The mounting plates preferably are made of a carbon steel having a lower carbon content than that of the fingers 410 and blades 22.

One design of the present invention comprises two sets of first frame mounting plates 420 and two sets of second frame mounting plates 422, wherein each set of mounting plates 420, 422 has fingers 410 attached thereto that have disposed through their slot 418 every other blade 22 of the respective frame. FIG. 11 shows a partial prospective view of this embodiment. Each blade 22 of each frame is preferably disposed through a finger 410. It is also preferred that each set of first frame mounting plates is aligned laterally and each set of second frame mounting plates is aligned laterally, which produces two rows of first frame mounting plates 420 that are perpendicular to the longitudinally extending blades 22 and two rows of second frame mounting plates 422 that are perpendicular to the longitudinally extending blades 22.

Alternatively, and more preferably, each blade guide 400 comprises three sets of first frame mounting plates 420 and three sets of second frame mounting plates 422. This is shown in FIG. 7. Each set of mounting plates has fingers 410 attached thereto that have disposed through their slot 418 every third blade 22 of the respective frame so that each blade 22 of each frame is disposed through at least one finger 410. It is preferred that each set of first frame mounting plates 420 is aligned laterally and each set of second frame mounting plates 422 is aligned laterally so that there are three rows of first frame mounting plates 420 that are perpendicular to the longitudinally extending blades 22 and three rows of second frame mounting plates 422 that are perpendicular to the longitudinally extending blades 22.

The design of the present invention using three sets of mounting plates is preferred over that using two sets because a larger surface area exists between the two adjacent fingers 410 along the upper end 428 of the mounting plate 420, 422. This larger surface area makes it more difficult for the fines and ribbons to build up and to affect the movement of the blades 22 of the frame that moves relative to the fingers. That is, as shown in FIG. 9, it is more difficult for material to accumulate in the area between fingers 410 so that the moving blade would be hindered. Thus, there is a lower likelihood of binding of or increasing the stresses associated with the blades 22 if the fingers 410 are spread further apart on a given mounting plate. Blade guides 400 having four or more sets of mounting plates 420, 422 are also possible. However, although these blade guides would provide an even greater surface area in which the build up of material would need to occur, the construction of these designs would be more elaborate and expensive, thus undermining the advantages. And, since blades 22 in the tensioning device are preferably in multiples of 15, the positioning member 470 shown in FIG. 10 is divided into three mounting plate supports so that each mounting plate 420, 422 has five evenly spaced fingers fixedly attached thereto for ease of manufacturing.

The wood chip sorter can use a single blade guide 400 that is disposed laterally through the frame through the longitudinal center of the path that the wood chips make through the screen. Thus, there would be one blade guide 400 at the midpoint of the frames. More preferably, there are a plurality of blade guides 400 on the wood chip sorter, wherein each blade guide 400 is longitudinally separated along the sorter from each other blade guide 400 at a desired distance. This desired separation is preferably at 1.2 meter (four (4) foot) increments, so that a sorter having a length of 3.6 meters (twelve (12) feet) has two blade guides at one-third and the two-thirds the distance along the length of the blades 22.

Referring back to FIGS. 7 and 11, the edge 416 of each finger 410 having a blade 22 of a respective one frame disposed through its slot 418 is adjacent one blade 22 of the other frame, thereby laterally supporting the blade 22 from the other frame. It is assumed for this discussion here that the mounting plates shown in FIG. 11 are first mounting plates 420. Thus, the blade of the second frame, labelled here as 22', moves relative to the fingers 410 that are fixedly attached to the first mounting plates 420 so that the blade 22' of the second frame is guided and laterally supported thereby. The blade 22' is also disposed through the slot 418 of a at least one finger 410 fixedly attached to one second frame mounting plate 422 (not shown). Both edges 416 of the finger 410 holding that blade 22' are adjacent the blades 22 from the first frame located on either side of the finger 410. Thus, the support pattern illustrated in FIG. 11 repeats itself for the first and second mounting plates 420, 422 of each blade guide. This pattern is best shown in FIG. 7, which shows that each blade 22 of each frame is disposed through at least one finger 410 and each blade 22 of each frame except the two outermost blades of the wood chip sorter is laterally supported by the edge 416 of at least two fingers 410 each having a blade 22 of the other frame disposed through their respective slots 418. Hence, the fingers 410 space and provide guidance to the moving blades in the outer frame as they pass through the inner frame guides and vice versa.

The vertical separation in the preferred embodiment between the upper end 428 of one mounting plate 420, 422 of one frame and a blade 22 of the other frame when the blade is at its relative lowest static position is 1.3 centimeters (one half(0.5) inch). This relationship is illustrated in FIG. 8. This distance ensures that the fines and ribbons likely do not build up enough to affect movement of the blade 22.

Although this blade guide 400 effectively inhibits prevents the build up of fines and ribbons in the surface area defined by the upper end 428 of the mounting plate 420, 422 and each two adjacent fingers 410, it has been found that further measures should be taken to remove any build up that may potentially occur. This objective can be satisfied by the blades 22 having a cutting means on their bottom edge. As illustrated in FIG. 8, the cutting means is disposed adjacent each mounting plate 420, 422 of the other frame that the blade 22 is disposed above, thereby preventing the bbuild upof wood fines or ribbons between the adjacent fingers 410 of that mounting plate 420, 422. These blades 22 preferably have a saw-tooth bottom 600 including a plurality of teeth 602 located in the bottom edge of the blade 22 to function as a cutting means which avoids the build up of ribbon-like material from wood chips. It is not necessary that the teeth 602 be formed along the entire length of blade bottom 600; however, it has been found to be particularly effective to have the saw-tooth portion at least at the bottom of the blades 22 near the region where those blades 22 extend over the mounting plates 420, 422 of the other frame, as shown in FIG. 8.

The blade guide 400 can further comprise a means for changing the elevational position of each blade 22, thereby allowing different blade heights to be used in the same frame. There are two ways to achieve having different relative blade heights: (1) use blades of different heights in the same frame or (2) use blades of the same height placed at different elevational positions. It is preferred to use blades of the same height so that all the blades have the same strength.

Figure 12B:
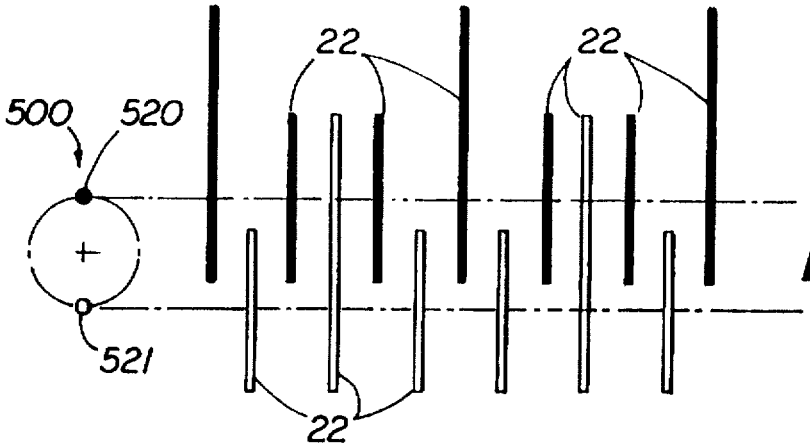
Figure 12C:
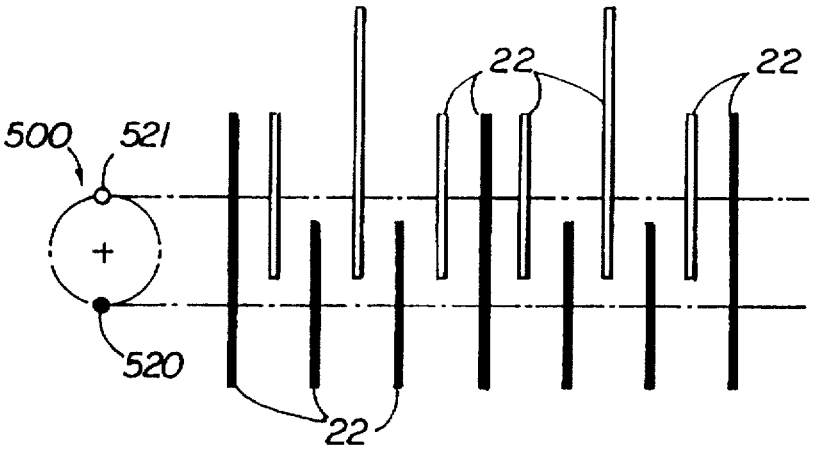

A wood chip sorter using blades with different relative heights provides operational advantages. Such a pattern is illustrated in FIGS. 12A, B, and C, in which an end view of a pattern of sets of adjacent blades 22 in the screen is shown. FIGS. 12A–C show blades 22 mounted on one of the frames, e.g., an inner frame, as thin, unfilled rectangles, while the blades 22 mounted on the other frame, e.g., an outer frame, are shown as solid bars. It will be recognized that which frame is identified as the inner frame and which is identified as outer frame is not important for purposes of this illustration. Two different heights of blades are used for ease of illustration and blades of the same height placed at different elevational positions may be substituted therefor. Graph 500 shows the relationship of the frames, as shown by corresponding solid dot 520 and empty dot 521. In FIG. 12A, the reciprocating motion of eccentric shafts coupled to the frames brings the frames into horizontal alignment, as indicated by graph 500, so that the frames are at equal vertical height. The reciprocating motion of the eccentric shafts is circular and the frames are preferably 180 degrees out of phase, as shown in graph 500.

FIG. 12B shows the blades after a 90 degree rotation through the reciprocating action. After another 90 degree rotation, an end view of the blades would again appear as in FIG. 12A. After yet another 90 degree rotation, the blades 22 will appear, in end view, as shown in FIG. 12C. The resulting vertical and horizontal motions of blades 22, together with their alternating sizes and relative placement, enhances the tilting of wood chips placed on the screen formed by the blades 22, which thereby enhances the sorting process.

The pattern shown in FIGS. 12A–C enhances the tilting action of the wood chips passing over and through the sorter. This pattern repeats itself using alternating higher blades and lower blades 22. Preferably, the blades 22 on each frame are arranged so that two lower blades are between each pair of higher blades 22, and that the higher blades of one frame are between a pair of lower blades 22 in the other frame. Other patterns are also possible, although tests have revealed that the described pattern is preferable.

Figure 9A:
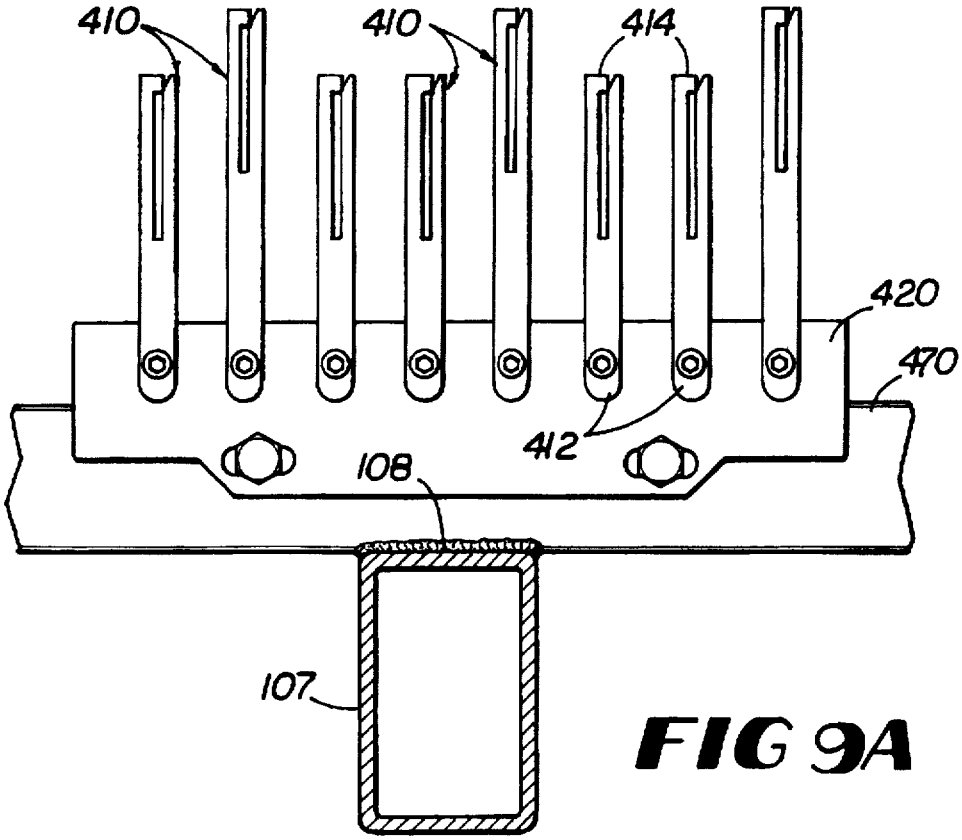
FIG. 9A is a front plan view of an alternative embodiment of the present invention shown in FIG. 9.
Figure 9B:
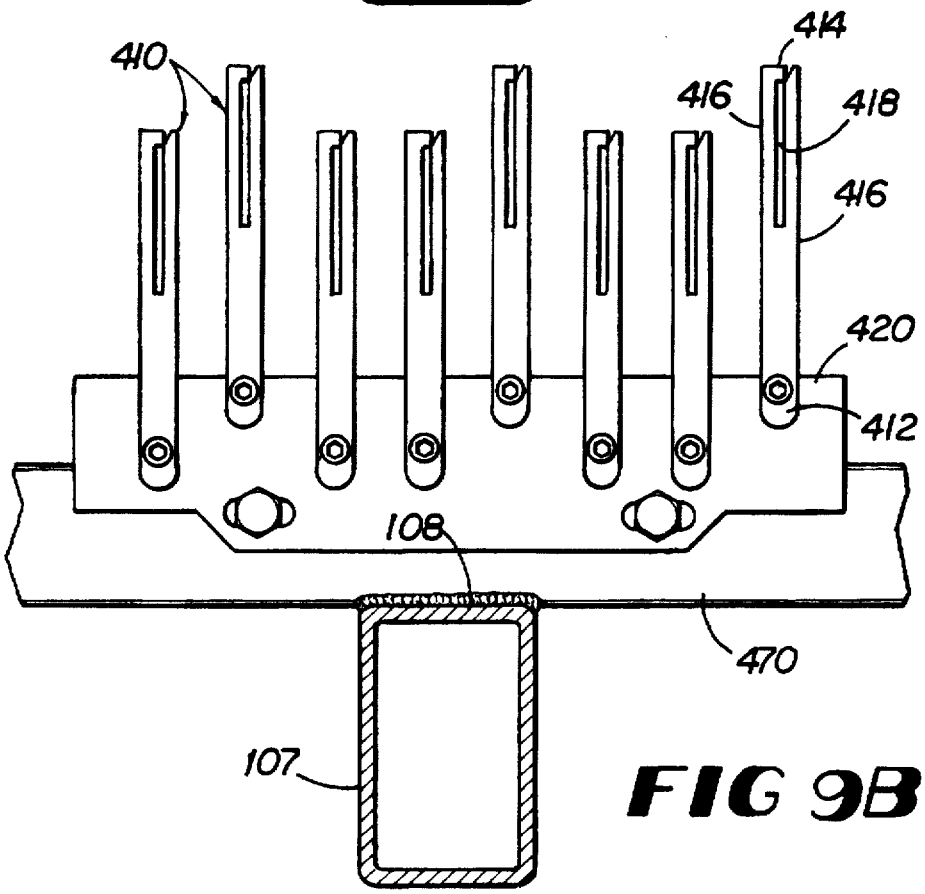
FIG. 9B is a front plan view of another embodiment of the present invention shown in FIG. 9.

The means for changing the elevational position of each blade in the present invention can comprise fingers 410 in which the distance between the bottom end 412 and the top end 414 of the finger 410 varies, as is shown in FIG. 9A. Alternatively, as shown in FIG. 9B, the changing means can comprise fixedly attaching the fingers 410 having the same size to the associated mounting plate 420, 422 so that the bottom end 412 of the finger 410 is disposed at a different distance from the upper end 428 of the frame mounting plate 420, 422 than that of another finger 410 on the same mounting plate 420, 422. Also, it is possible to locate the slot 418 of the fingers 410 at different heights relative to the upper end 428 of the mounting plate 420, 422. If the blades 22 are different heights, as shown in FIGS. 12A–C, then the dimensions of the slots 418 can be altered accordingly.

As shown in FIGS. 13 and 14, the present invention also comprises another blade guide 400 for use in a wood chip sorter that has a first and second frame, each frame having a plurality of longitudinally extending blades 22. This blade guide 400 comprises an elongated bracket 440 fixedly attached and laterally disposed relative to a respective one of the frames and having a plurality of vertically disposed, laterally spaced apart slots 445, 450 therethrough, the slots comprising first slots 445 and second slots 450 which have a lower end 452, and a means for preventing the build up of wood fines or ribbons adjacent the lower end 452 of at least one second slot 450.

Each of the first slots 445 are of a size to receive therein one of the blades 22 of the frame to which the bracket 440 is fixedly attached so that each blade 22 disposed through each of the first slots 445 is restricted from moving in a lateral and a vertical direction along at least a portion of the length of the blade 22. The first slots 445 preferably are of a size to allow different size blades 22 or different positioning of the blades 22 so that the pattern shown in FIGS. 12A–C is used. The blades 22 can be positioned at different heights in the first slot 445 by having press-fit snaps through the blades 22 and inserted into one of two cavities 468 as shown in FIG. 14. The press-fit snaps can be similar to those shown in FIG. 4 that are used for tensioning the blades 22, wherein the press-fit snap 42 has two sections 42A, 42B that fit through a hole 43 in the blade 22.

Each of the second slots 450 has an upper end 454 and an opposite lower end 452 and is of a size to receive therein one of the blades 22 of the second frame and to accommodate the blade 22 as it moves relative to the bracket 440. Each blade disposed through each of the second slots 450 is restricted from moving in the lateral direction along at least a portion of the length of the blade 22.

The preventing means can comprise the bracket 440 defining an opening 460 below the lower end 452 of the second slot 450 and having a top portion 462 and an opposite bottom portion 464. The top portion 460 is in flow communication with the lower end 452 of the second slot 450, whereby the wood fines or ribbons are removed from the second slot 450 and the opening 460 by the relative motion of the blade 22 therein. It is preferred that the width of the opening 460 increases moving downwardly from the top portion 462 of the opening 460 to the bottom portion 464 of the opening 460 as shown in FIG. 13. The opening 460, however, may use other patterns that assist in the removal of fines and ribbons.

The preventing means can also comprise a cutting means on the bottom edge of one blade 22 disposed through one second slot 450 so that the cutting means is located adjacent the lower end 452 of the second slot 450. The cutting means cuts up and removes the wood fines and ribbons from the second slot 450 by the relative motion of the blade 22 therein. The cutting means preferably comprises a saw-tooth configuration 600 on the bottom edge of the blade 22, which is shown in FIG. 8.

It is more preferred that the preventing means comprises both (1) the bracket 440 defining an opening 460 below the lower end 452 of the second slot 450 and having a top portion 462 and an opposite bottom portion 464, the top portion 462 being in flow communication with the lower end 452 of the second slot 450, and (2) a cutting means on the bottom edge of one blade 22 disposed through one second slot 450, the cutting means being located adjacent the lower end 452 of the second slot 450. This preventing means cuts up and removes the wood fines and ribbons from the second slot 450 and the opening 460 by the relative motion of the blade 22 therein.

Although the present invention has been described with reference to specific details of certain embodiments thereof, it is not intended that such details should be regarded as limitations upon the scope of the invention except as and to the extent that they are included in the accompanying claims.

What is claimed is:

1. A blade guide for use in a dual-frame wood chip sorter comprising a first and second frame, each frame having a front frame member, an opposite rear frame member, two opposed side frame members, a plurality of longitudinally extending blades, and at least one longitudinally extending support member disposed below the blades, intermediate the two side frame members, and being connected to the front and rear frame members and having a top surface, comprising:

a) a plurality of elongated fingers, each finger having a bottom end, an opposite top end, two opposing edges, and a slot therethrough intermediate the two edges of the finger, the slot being of a size to receive therein one of the blades;

b) at least two first frame mounting plates, each first frame mounting plate having a lower end fixedly attached to the top surface of the support member of the first frame and an opposite upper end fixedly attached to the bottom end of at least two fingers, wherein each of the attached fingers has a blade of the first frame disposed through its slot, wherein at least one blade of the first frame is disposed intermediate adjacent fingers attached to each first frame mounting plate, each finger that has one of those intermediate blades of the first frame disposed through its slot being attached to another first frame mounting plate that is longitudinally separated within the first frame from the other first frame mounting plate by a predetermined distance; and c) at least two second frame mounting plates, each second frame mounting plate having a lower end fixedly attached to the top surface of the support member of the second frame and an opposite upper end fixedly attached to the bottom end of at least two fingers, wherein each of the attached fingers has a blade of the second frame disposed through its slot, wherein at least one blade of the second frame is disposed intermediate adjacent fingers attached to each second frame mounting plate, each finger that has one of those intermediate blades of the second frame disposed through its slot being attached to another second frame mounting plate that is longitudinally separated within the second frame from the other second frame mounting plate by a predetermined distance.

2. The blade guide of claim 1, wherein adjacent first frame mounting plates and second frame mounting plates are separated longitudinally from each other by a predetermined distance.

3. The blade guide of claim 1, wherein each blade guide comprises two sets of first frame mounting plates and two sets of second frame mounting plates, wherein each set of mounting plates has fingers attached thereto that have disposed through their slot every other blade of the respective frame, each blade of each frame being disposed through a finger.

4. The blade guide of claim 3, wherein each set of first frame mounting plates is aligned laterally and each set of second frame mounting plates is aligned laterally, whereby there are two rows of first frame mounting plates that are perpendicular to the longitudinally extending blades and two rows of second frame mounting plates that are perpendicular to the longitudinally extending blades.

5. The blade guide of claim 1, wherein each blade guide comprises three sets of first frame mounting plates and three sets of second frame mounting plates, wherein each set of mounting plates has fingers attached thereto that have disposed through their slot every third blade of the respective frame, each blade of each frame being disposed through a finger.

6. The blade guide of claim 5, wherein each set of first frame mounting plates is aligned laterally and each set of second frame mounting plates is aligned laterally, whereby there are three rows of first frame mounting plates that are perpendicular to the longitudinally extending blades and three rows of second frame mounting plates that are perpendicular to the longitudinally extending blades.

7. The blade guide of claim 1, wherein the blade guide is disposed laterally through the frame through the longitudinal center of the path of wood chips through the sorter.

8. The blade guide of claim 1, wherein there are a plurality of blade guides on the wood chip sorter, wherein each blade guide is longitudinally separated along the sorter from each other blade guide at a desired distance.

9. The blade guide of claim 1, wherein the edge of each finger having a blade of a respective one frame disposed through its slot is adjacent one blade of the second frame, thereby laterally supporting the blade from the second frame.

10. The blade guide of claim 9, wherein each blade of each frame is disposed through at least one finger and wherein each blade of each frame except the two outermost blades of the wood chip sorter is laterally supported by the edge of at least two fingers that have a blade of the second frame disposed through their respective slots.

11. The blade guide of claim 1, wherein each blade has a bottom edge, wherein at least one blade has a cutting means in its bottom edge so that the cutting means is disposed adjacent each mounting plate of the other frame that the blade is disposed above, thereby preventing the build up of wood fines or ribbons between the fingers of that mounting plate.

12. The blade guide of claim 11, wherein the cutting means comprises a saw-tooth configuration.

13. The blade guide of claim 1, further comprising means for changing the elevational position of each blade, thereby allowing different blade heights to be used in the same frame.

14. The blade guide of claim 13, wherein the changing means comprises fingers in which the distances between the bottom end and the top end of the finger varies.

15. The blade guide of claim 13, wherein the changing means comprises fixedly attaching the fingers to the associated mounting plate so that the bottom end of the finger is disposed at a different distance from the upper end of the frame mounting plate than that of another finger on the same mounting plate.

16. A blade guide for use in a wood chip sorter having a first and second frame, each frame having a plurality of longitudinally extending blades and each blade having a bottom edge, comprising:

a) an elongated bracket fixedly attached and laterally disposed relative to a respective one of the frames and having a plurality of vertically disposed, laterally spaced apart slots therethrough comprising first and second slots, each of the first slots being of a size to receive therein one of the blades of the frame to which the bracket is fixedly attached, each blade disposed through each of the first slots being restricted from moving in a lateral and a vertical direction along at least a portion of the length of the blade, and each of the second slots having an upper end and an opposite lower end and being of a size to receive therein one of the blades of the second frame and to accommodate the blade as it moves relative to the bracket, each blade disposed through each of the second slots being restricted from moving in the lateral direction along at least a portion of the length of the blade; and b) means for preventing the build up of wood fines or ribbons adjacent the lower end of the second slot, wherein the preventing means comprises the bracket defining an opening below the lower end of the second slot with the opening having top portion and an opposite bottom portion, the top portion being in flow communication with the lower end of the second slot, wherein the width of opening increases moving downwardly from the top portion of the opening to the bottom portion of the opening.

17. The blade guide of claim 16, wherein the preventing means comprises a cutting means on the bottom edge of one blade disposed through one second slot, the cutting means being located adjacent the lower end of the second slot, whereby the wood fines and ribbons are cut up and removed from the second slot by the relative motion of the blade therein.

18. The blade guide of claim 17, wherein the cutting means comprises a saw-tooth configuration on the bottom edge of the blade.

19. The blade guide of claim 16, wherein the preventing means comprises:

a) the bracket defining an opening below the lower end of the second slot and having a top portion and an opposite bottom portion, the top portion being in flow communication with the lower end of the second slot; and b) a cutting means on the bottom edge of one blade disposed through one second slot, the cutting means being located adjacent the lower end of the second slot, whereby the wood fines and ribbons are cut up and removed from the second slot and the opening by the relative motion of the blade therein.

20. A blade guide for use in a wood chip sorter comprising at least one frame, the frame having a front frame member, an opposite rear frame member, a plurality of longitudinally extending blades, and at least one longitudinally extending support member having a top surface and being disposed below the blades, comprising:

a) a plurality of elongated fingers, each finger having a body portion with a bottom end, an opposite top end, and two opposing edges, the body portion defining a slot therethrough intermediate the two opposing edges of the finger, the slot being of a size to receive therein one of the blades; and b) primary and secondary frame mounting plates, the primary frame mounting plate having a lower end fixedly attached to the top surface of the support member and an opposite upper end fixedly attached to the bottom end of at least two fingers in which the edge of one finger is spaced apart from the edge of an adjacently mounted finger, wherein each of the attached fingers has a blade disposed through its slot, wherein at least one blade of the frame is disposed intermediate adjacent fingers attached to each frame mounting plate, with each finger that has one of those intermediate blades disposed through its slot being attached to the secondary frame mounting plate that is longitudinally separated from the primary frame mounting plate.

* * * * *